US007048579B2

(12) United States Patent
Montena

(10) Patent No.: US 7,048,579 B2
(45) Date of Patent: May 23, 2006

(54) COMPRESSION CONNECTOR FOR COAXIAL CABLE

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/092,197

(22) Filed: Mar. 29, 2005

(65) Prior Publication Data

US 2006/0014426 A1 Jan. 19, 2006

Related U.S. Application Data

(63) Continuation-in-part of application No. 10/892,645, filed on Jul. 16, 2004.

(51) Int. Cl.
*H01R 9/05* (2006.01)

(52) U.S. Cl. ..... 439/578; 439/584; 439/585

(58) Field of Classification Search ..... 439/578–585
See application file for complete search history.

(56) References Cited

U.S. PATENT DOCUMENTS

| | | | | |
|---|---|---|---|---|
| 3,184,706 | A | 5/1965 | Atkins | 439/584 |
| 3,846,738 | A | 11/1974 | Nepovirn | 439/584 |
| 4,053,200 | A | 10/1977 | Pugner | 439/578 |
| 4,059,330 | A | 11/1977 | Shirey | 439/578 |
| 4,126,372 | A | 11/1978 | Hashimoto | 439/583 |
| 4,408,822 | A | 10/1983 | Nikitas | 439/587 |
| 4,583,811 | A | 4/1986 | McMills | 439/584 |
| 4,650,228 | A | 3/1987 | McMills | 285/381.4 |
| 4,668,043 | A | 5/1987 | Saba | 439/585 |
| 4,676,577 | A | 6/1987 | Szegda | 439/584 |
| 4,902,246 | A | 2/1990 | Samchisen | 439/578 |
| 5,024,606 | A | 6/1991 | Ming Hwa | 439/578 |
| 5,073,129 | A | 12/1991 | Szegda | 439/585 |
| 5,470,257 | A | 11/1995 | Szegda | 439/578 |
| 5,564,942 | A | 10/1996 | Lee | 439/462 |
| 5,607,325 | A | 3/1997 | Toma | 439/578 |
| 5,651,698 | A | 7/1997 | Locati et al. | 439/578 |
| 5,879,191 | A * | 3/1999 | Burris | 439/584 |
| 5,975,951 | A | 11/1999 | Burris | 739/585 |
| 5,997,350 | A | 12/1999 | Burris et al. | 439/585 |
| 6,019,636 | A | 2/2000 | Langham | 439/585 |
| 6,032,358 | A | 3/2000 | Wild | 29/863 |
| 6,089,913 | A | 7/2000 | Holliday | 439/584 |
| 6,146,197 | A | 11/2000 | Holliday | 439/585 |
| 6,153,830 | A | 11/2000 | Montena | 174/886 |
| 6,210,222 | B1 | 4/2001 | Langham | 439/583 |
| 6,217,383 | B1 * | 4/2001 | Holland et al. | 439/578 |
| 6,331,123 | B1 | 12/2001 | Rodrigues | 439/584 |

* cited by examiner

*Primary Examiner*—Michael C. Zarroli
(74) *Attorney, Agent, or Firm*—Wall Marjama & Bilinski LLP

(57) ABSTRACT

A coaxial cable compression connector includes a connector body having a first end and a second end, and an internal passageway. The compression connector further includes a tubular post having a first end configured for engagement with the conductive grounding sheath of the coaxial cable and a second end configured for engagement with the internal passageway of the body. The connector further includes a compression member. The first end of the compression member includes an outer surface and a tapered inner surface, the outer surface is configured for engagement with a portion of the internal passageway at the first end of the body. The connector further includes a ring member which is configured for engagement with the tapered inner surface of the compression member.

20 Claims, 22 Drawing Sheets

COMPRESSION CONNECTOR FOR COAXIAL CABLE

CROSS REFERENCE TO RELATED APPLICATION

This application is a continuation in part of U.S. Ser. No. 10/892,645 filed Jul. 16, 2004.

FIELD OF THE INVENTION

This invention relates to terminals for coaxial cables and more particularly to compression connectors for coaxial cables.

BACKGROUND OF THE INVENTION

The deployment of 50 ohm coaxial cable, such as, for example 200, 400 and 500 sizes of cable, for video and data transfer is increasing. Present 50 ohm connectors require labor intensive and craft sensitive installation. In one proposed approach, the 50 ohm connector is supplied as a kit and is assembled onto a coaxial cable in stages. The assembly must occur in a set order and may require soldering for proper assembly. Another proposed approach uses multiple threaded body sections and requires the use of multiple wrenches to draw the separate body sections together thereby exerting a clamping force on to the cable. The connectors used in both of these approaches are relatively expensive due to the number of precision parts involved. Furthermore, both of these approaches are prone to installation errors that may not be readily apparent to the installer, e.g., the threaded body sections are not fully tightened together. Additionally, many of the approaches used to install connectors on the ends of coaxial cables have relied on a component of the connector forcefully moving against the outer conductor and/or the protective jacket of the cable. The relative motion between the connector component and the cable may result in damage to the cable which in turn may degrade the operational effectiveness and reliability of the deployed cable or its connection.

Additionally, the preparation of an end of a smaller diameter coaxial cable for the installation of a connector can lead to a larger than normal profile due to the 50 ohm braid. This increased profile and the requirement that the post of the connector is forced under the braid layer which stretches the braid and the cable jacket requires a larger clearance diameter for inserting the cable into the connector.

Furthermore, it is desirable to keep the distance from the opening of the connector to the end of the post as short as possible. Keeping this distance as short as possible aids the installer in aligning the center conductor and dielectric layer for insertion within the post.

Therefore there is a need for a connector for 50 ohm coaxial cables that is simple to install, effective at establishing both electrical and mechanical engagement to the cable, and overcomes the aforementioned problems.

SUMMARY OF THE INVENTION

Therefore, and according to one illustrative embodiment of the present invention, there is provided a compression connector for the end of a coaxial cable. The coaxial cable has a center conductor surrounded by a dielectric layer, the dielectric layer being surrounded by a conductive grounding sheath, and the conductive grounding sheath being surrounded by a protective outer jacket. The grounding sheath may include a single layer of foil with a metal braided mesh or multiple layers of conductive foil and a braided mesh of conductive wire. The compression connector includes a body having a first end and a second end, the body defines an internal passageway. The compression connector further includes a tubular post having a first end and a second end. The first end is configured for engagement with a portion of the conductive grounding sheath and may be inserted between the conductive grounding sheath and the dielectric layer of the coaxial cable. A portion of the second end of the tubular post is configured for engagement with the body at a predetermined position within the internal passageway. The compression connector further includes a compression member having a first end and a second end. The first end includes an outer surface and an inner surface, the outer surface is configured for engagement with a portion of the internal passageway at the first end of the body. The compression connector further includes a ring member having first end, a second end and a cylindrical inner surface. The first end of the ring member is configured for engagement with the inner surface of the compression member.

According to another embodiment of the present invention there is provided a compression connector for the end of a coaxial cable. The coaxial cable includes a center conductor surrounded by a dielectric layer, the dielectric layer being surrounded by a conductive grounding sheath, and the conductive grounding sheath being surrounded by a protective outer jacket. The compression connector includes a connector body having a first end, a second end and a longitudinally extending passageway including at least one shoulder. The compression connector further includes a compression sleeve wedge configured for slideable engagement within the passageway of the connector body. The compression sleeve wedge includes a ramped inner surface. The compression connector further includes a compression ring disposed between the connector body and the compression wedge. The compression ring is disposed adjacent to the compression wedge and the compression ring is configured to receive the outer surface of the protective outer jacket. The compression ring includes an outer surface configured for engagement with the ramped inner surface. The compression connector further includes a post at least partially disposed within the connector body. The post is configured to abut the compression ring and includes an end configured for insertion between the grounding sheath and the dielectric layer to engage at least a portion of the grounding sheath.

According to another embodiment of the present invention there is provided a compression connector for the end of a coaxial cable. The coaxial cable includes a center conductor surrounded by a dielectric layer, the dielectric layer being surrounded by a conductive grounding sheath, and the conductive grounding sheath being surrounded by a protective outer jacket. The compression connector includes a body having a first end and a second end, with the body defining an internal passageway. The compression connector further includes a tubular post having a first end and a second end. The first end of the post is configured for engagement with the conductive grounding sheath and a portion of the second end of the post is configured for engagement with the body between the first and the second end of the internal passageway. The compression connector further includes a compression member. The compression member has a first end and a second end. The compression member is moveable from a first position at the first end of the body to a second position within the body. The first end includes an outer surface and an inner surface, the outer surface is configured for engagement with a portion of the internal passageway at the first end of the body. The compression connector further includes a compression element. The compression element has a first end, a second end and an inner surface. The first end of the compression element is configured for engagement with the inner surface of the compression member and the inner surface of the compression member is configured to cause the compression element to radially inwardly change shape upon advancement of the compression member from the first position to the second position.

According to another embodiment of the present invention there is provided a compression connector for the end of a coaxial cable. The coaxial cable includes a center conductor surrounded by a dielectric layer, the dielectric layer being surrounded by a conductive grounding sheath, and the conductive grounding sheath being surrounded by a protective outer jacket. The compression connector includes means for electrically connecting the coaxial cable to an electrical device; means for receiving the coaxial cable; and means for applying a circumferential clamping force to the protective outer jacket of the coaxial cable whereby the coaxial cable is coupled to or engaged with the compression connector.

According to yet another embodiment of the present invention there is provided a compression connector for the end of a coaxial cable. The coaxial cable has a center conductor surrounded by a dielectric layer, the dielectric layer being surrounded by a conductive grounding sheath, and the conductive grounding sheath being surrounded by a protective outer jacket. The compression connector includes a body having a first end and a second end, the body defines an internal passageway. The compression connector further includes a tubular post having a first end and a second end. The first end is configured for insertion between the conductive grounding sheath and the dielectric layer of the coaxial cable. A portion of the second end of the tubular post is configured for engagement with the body at a predetermined position within the internal passageway. The compression connector further includes a compression member having a first end and a second end. The first end includes an outer surface and a tapered inner surface, the outer surface is configured for engagement with a portion of the internal passageway at the first end of the body. The compression member at the first end of the body is at a first position and can be moved to a second position. The compression connector further includes a ring member having first end, a second end and a cylindrical inner surface. The first end of the ring member is configured for engagement with the tapered inner surface of the compression member. The tapered or inner surface of the compression member is configured to cause the ring member to radially inwardly change shape upon advancement of the compression member from the first position to the second position.

According to yet another embodiment of the present invention, there is provided a method for installing a compression connector on the end of a coaxial cable. The coaxial cable has a center conductor surrounded by a dielectric layer, the dielectric layer being surrounded by a conductive grounding sheath, and the conductive grounding sheath being surrounded by a protective outer jacket. The method includes the step of providing a connector in a first preassembled configuration. The connector includes a connector body defining an internal passageway and a post member configured and dimensioned for insertion into the internal passageway of the connector body. The post member is dimensioned for an interference fit with the connector body. The post member also defines an inner first cavity and includes a first opening and a second opening each communicating with the inner first cavity. The post member further includes a base proximate to the second opening, a ridge proximate to the second opening and a protrusion disposed on an outer annular surface. The post member and the connector body define a first cavity. The compression connector further includes a compression ring or compression element disposed in the first cavity. The compression ring is configured and dimensioned to receive an end of the coaxial cable. The compression connector further includes a compression wedge disposed in a first position proximate to the compression ring thereby allowing the compression ring to receive the end of the coaxial cable. The method further includes the steps of preparing an end of the coaxial cable by separating the center conductor and insulator core from the outer conductor and sheath. The method further includes the step of inserting the prepared coaxial cable end into the connector such that the base of the post member engages the conductive grounding sheath of the coaxial cable and the compression ring is proximate to the protective outer jacket. The method further includes the step of using a tool that engages the compression wedge and the connector body, forcibly sliding the compression wedge from the preassembled first configuration, to an assembled second configuration such that the compression wedge concentrically compresses at least a portion of the compression ring radially inwardly such that the post member and the compression ring provide a continuous 360° engagement with the outer conductor and protective outer jacket of the coaxial cable.

The use of a floating, deformable compression ring as described above solves two of the problems associated with installing 50 ohm connectors on smaller diameter coaxial cables. First, the use of a deformable compression ring results not only in the ability to accommodate different cable diameters but reduces the distance between the opening of the connector and the end of the post. This permits reducing the required insertion length of the prepared cable to be relatively short. Additionally, the floating nature of the compression ring makes possible the advantageous configuration of completely trapping the compression ring within the body of the compression connector, thereby ensuring that the compression ring remains in place prior to installation on a cable. The floating ring of the present invention removes the element of relative motion between the connector compression wedge and the cable. The compression wedge of the present invention slides along the outer surface of the compression ring. The compression ring therefore serves to isolate the cable from the moving compression wedge from the cable, thereby preventing both dislocation of the cable within the connector and damage to the cable from the sliding compression wedge.

In a still further embodiment of the present invention there is provided a compression connector for the end of a coaxial cable. The compression connector includes a connector body which includes first and second ends and a stepped internal passageway. The first end of the connector body receives a deformable post and compression wedge. The deformable post includes an inner sleeve, an outer sleeve, a first open end and a second end which maintains the positions of inner and outer sleeves with respect to one another. The inner sleeve of the deformable post is sized and configured to be inserted between the dielectric layer and grounding shield of a prepared end of a coaxial cable. The outer sleeve includes a shoulder to mate with the internal passageway of the connector body and an inwardly tapered trailing edge at the open end to engage the ramped inner surface of the compression wedge. The second end of the connector body includes any of the well known connector interfaces, such as a BNC connector, an F-type connector, an RCA-type connector, a DIN male connector, a DIN female connector, an N male connector, an N female connector, an SMA male connector and an SMA female connector. The compression wedge is press fitted into the rear open end of the connector body in a first preassembled configuration. The inner and outer sleeves of the deformable post define an annular space which is open at the second end for receiving the conductive grounding sheath and the protective outer jacket layers of the coaxial cable. As the compression wedge is axially advanced, the ramped inner surface of the compression wedge slides over the outer sleeve, and reduces the volume of the annular space between the inner and outer sleeves of the deformable post. The outer sleeve is thus deformed into a 360° engagement with the outer surface of the cable.

It is to be understood that both the foregoing general description and the following detailed description are merely illustrative examples of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operations of the invention.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
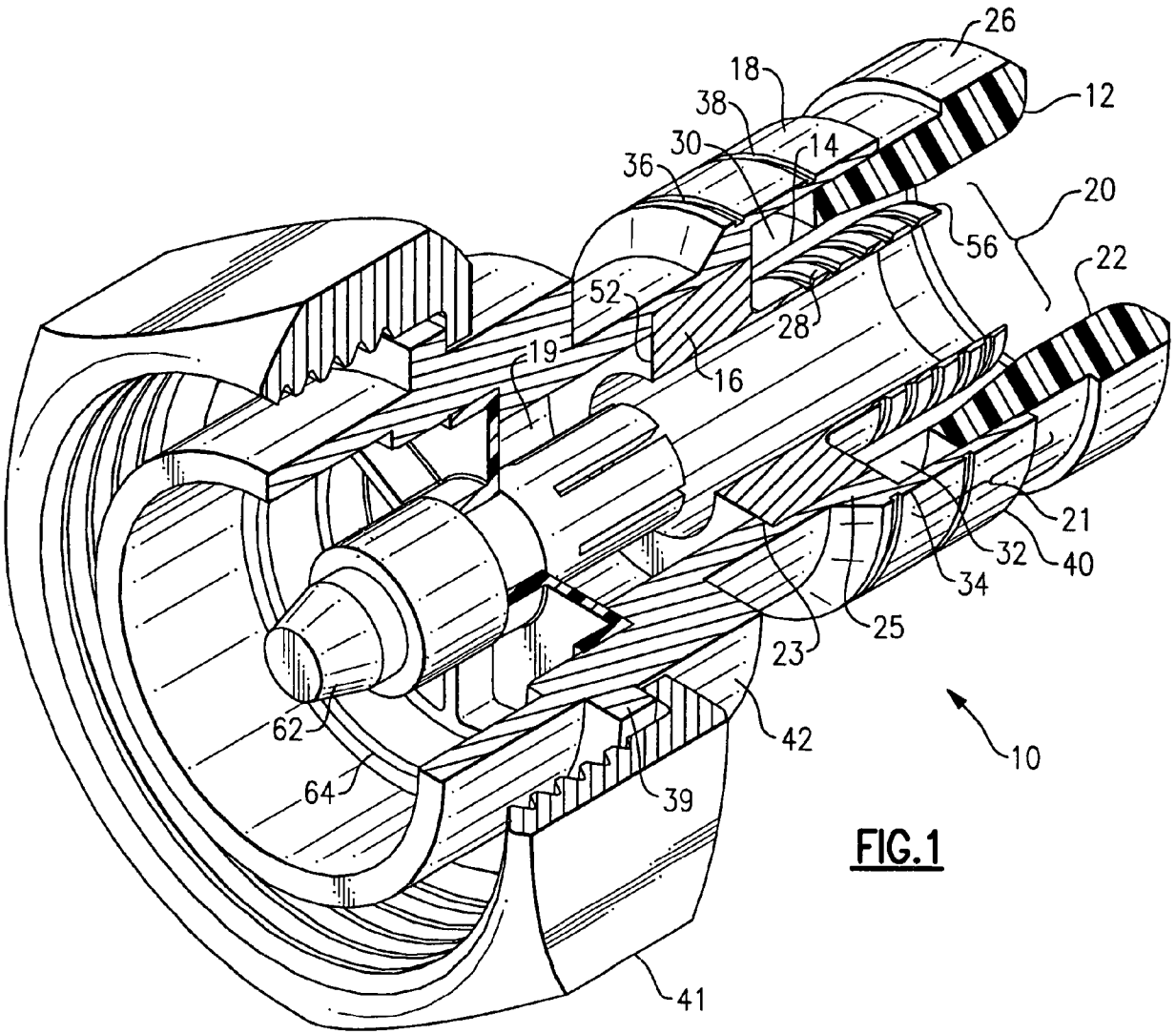
FIG. 1 is a cutaway perspective view of one embodiment of the present invention depicting the compression member in the first position.

Reference will now be made in detail to the present preferred embodiments of the invention, examples of which are illustrated in the accompanying drawings. Whenever possible, the same reference numerals will be used throughout the drawings to refer to the same or like parts for clarity.

Figure 2:
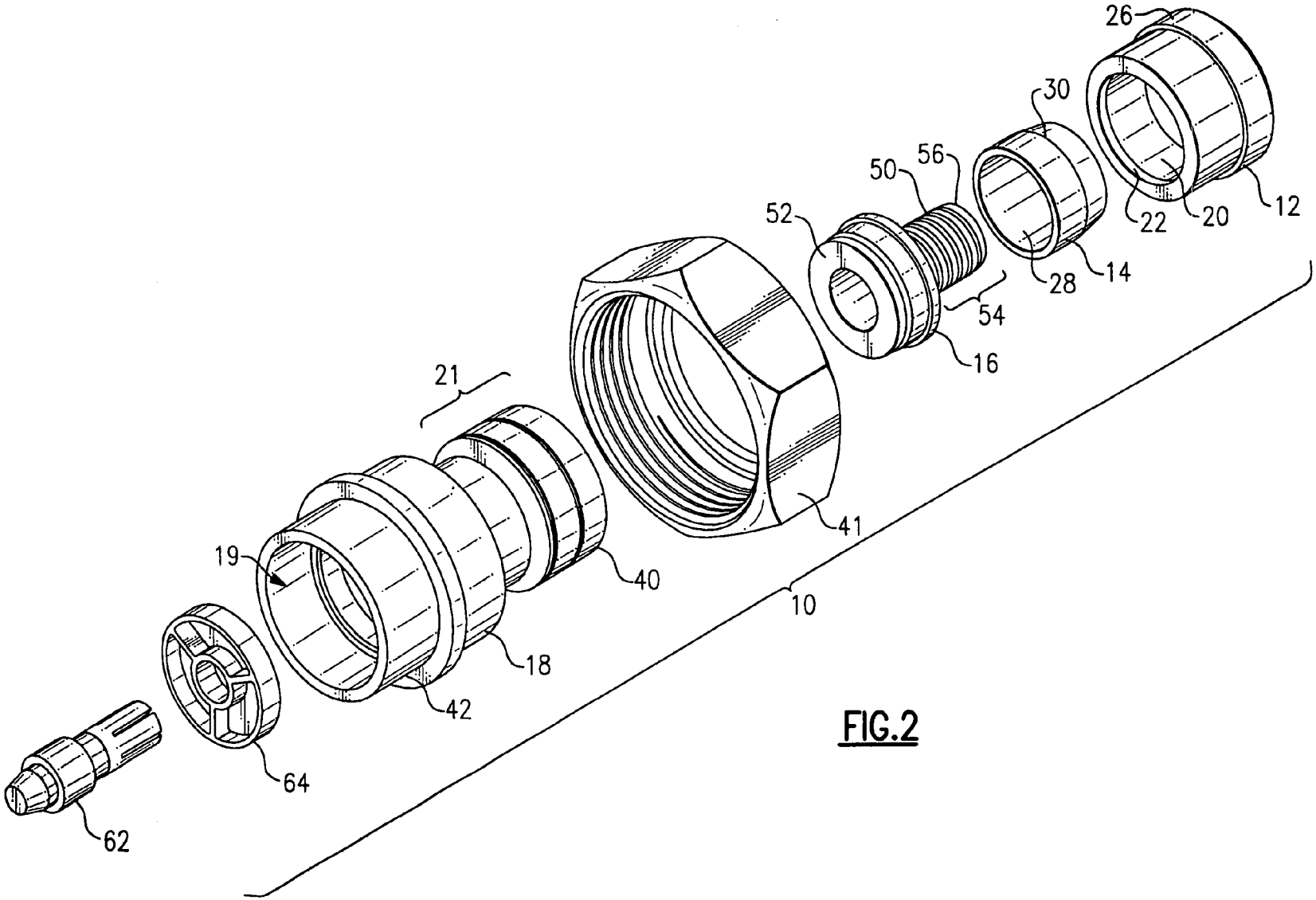
FIG. 2 is an exploded perspective view of the embodiment of the present invention shown in FIG. 1.

According to one embodiment, as shown in FIG. 1, the present invention for a compression connector 10 for a coaxial cable. The embodiment of the compression connector 10 shown in FIGS. 1 and 2 is configured as a DIN male connector interface; further embodiments of the present invention incorporating different connector interfaces are described below. Coaxial cable typically includes a center conductor surrounded by a dielectric layer, which is in turn surrounded by an outer conductor or grounding sheath. The outer conductor may include layers of conductive foils, a braided mesh of conductive wires or a combination of both. The outer conductor or grounding sheath is in turn surrounded by an outer protective jacket.

The compression connector 10 includes a compression member in one form a compression wedge 12, a compression element in one form a ring member 14, a post 16 and a connector body 18. The connector body 18 includes a proximal end 40 and a distal end 42. The connector body 18 further includes a central opening 19 extending from the proximal end 40 to the distal end 42. The central opening 19 extends along the longitudinal axis of the connector body 18. The central opening 19 is substantially circular in cross section with the diameter varying along the length of the connector body 18. The end 21 of the central opening 19 adjacent to the proximal end 40 of the connector body 18 is configured to receive the compression wedge 12. In one form the body 18 and wedge 12 define an enclosed space 20 that surrounds the compression ring 14 and the post 16. The central opening 19 can include two internal shoulders 23, 25. The first internal shoulder 23 is configured to receive an end 52 of the post 16. The second internal shoulder 25 defines one boundary of a cavity 32 defined by the post 16 in the central opening 19. The cavity 32 is sized to receive both the compression wedge 12 and the compression ring 14. The connector body 18 further includes two annular grooves 36, 38 disposed on the exterior of the body proximate to the end 21 of the central opening 19. The distal end 42 of the connector body 18 includes a shoulder 39 for retaining an internally threaded nut 41 for use in coupling the compression connector to a complimentary fitting.

The compression wedge 12 includes a central opening 20 oriented along the longitudinal axis of to the compression wedge 12. The central opening 20 is substantially circular in cross section and is sized for a clearance fit with the outer protective jacket of a coaxial cable (not shown). The central opening 20 can include a tapered inner surface 22 having a substantially conical profile. The tapered inner surface 22 engages the outer surface 30 of the compression ring 14 to produce a radially inward force against the compression ring 14 as the compression wedge 12 is moved from a first position as shown in FIG. 1 towards a second position as shown in FIG. 2 during installation of the compression connector 10 onto the end of a coaxial cable. The compression wedge 12 also includes a circumferential ring 26 configured for engagement with a compression tool. The circumferential ring 26 may also be positioned so as to control the distance the compression wedge 12 advances into the connector body 18 during installation. Typically, the compression wedge 12 is made from a metallic material, such as, for example brass or a resilient plastic, such as, for example Delrin®. The circumferential ring 26 may also be used to provide a visual indication that the compression connector 10 has been properly connected to the coaxial cable.

The compression ring 14 is made of a deformable material and in one form can be plastic but metal is also possible. The compression ring includes an inner surface 28 and an outer surface 30. The inner surface 28 is configured to slide onto the end of the coaxial cable. The compression ring 14 may be a substantially cylindrical body or may employ internal and/or external tapered surfaces. The inner surface 28 may include a tapered region to facilitate sliding onto the end of the coaxial cable. Before the coupling of the compression connector 10 to the coaxial cable, the compression ring 14 is maintained in position within the connector body by compression wedge 12. During the coupling of the compression connector 10 to the coaxial cable, the compression ring 14 butts against either the second internal shoulder 25 of the connector body 18 or a shoulder on the post, as the design may dictate, thereby stopping the axial movement of the compression ring 14. Further axial movement of the compression wedge 12 then results in the generation of a radial inward force on the compression ring 14 which clamps the compression ring to the outer protective jacket and the braided grounding layer, thereby securely coupling the coaxial cable to the compression connector 10. In a preferred arrangement, the compression ring 14 is completely disposed within the proximal end 40 of the connector body 18.

The post 16 includes a proximal end 50 and a distal end 52. The proximal end 50 is configured for insertion between the dielectric layer and the braided grounding layer of the coaxial cable thereby capturing at least a portion of the braided grounding layer and the outer protective jacket of the coaxial cable between the inner surface 28 of the compression ring 14 and the proximal end 50 of the post 16. A shoulder 60 can separate the proximal end 50 from the distal end 52. The proximal end 50 includes a cylindrical region 54 which in one configuration may be as long as the compression ring 14. As shown, the proximal end 50 may include a barb or series of barbs 56 for aid in securing the coaxial cable to the compression connector 10. The distal end 52 of the post 16 is configured to abut the first internal shoulder 23 of the central opening 19 of the connector body 18. In one embodiment, the distal end 52 of the post 16 is sized to have an interference fit with the walls of the central opening 19 to aid in maintaining its position within the connector body.

Figure 1A:
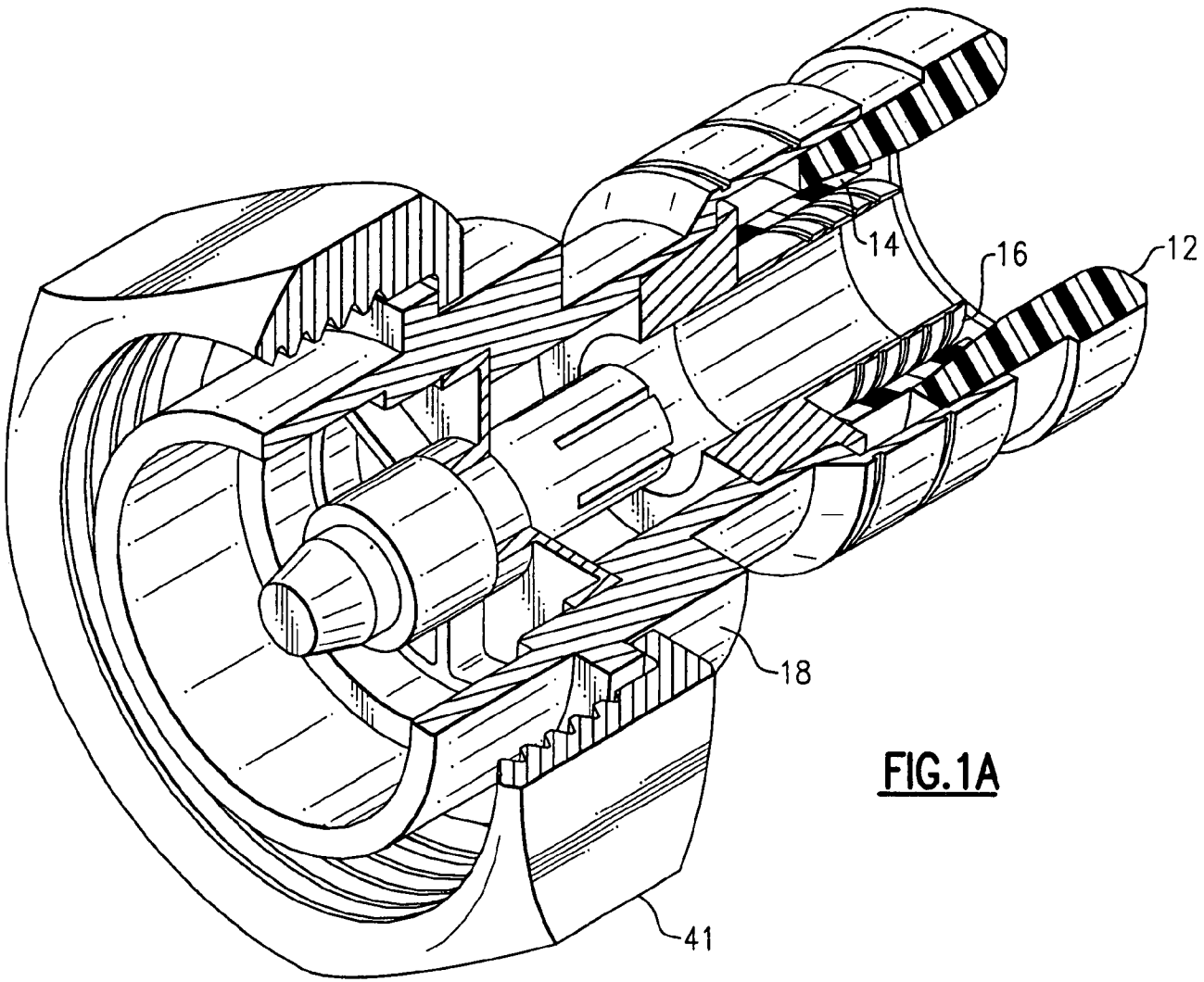
FIG. 1A is cutaway perspective view of the embodiment of the present invention shown in FIG. 1 with the compression wedge in the installed second position.
Figure 1B:
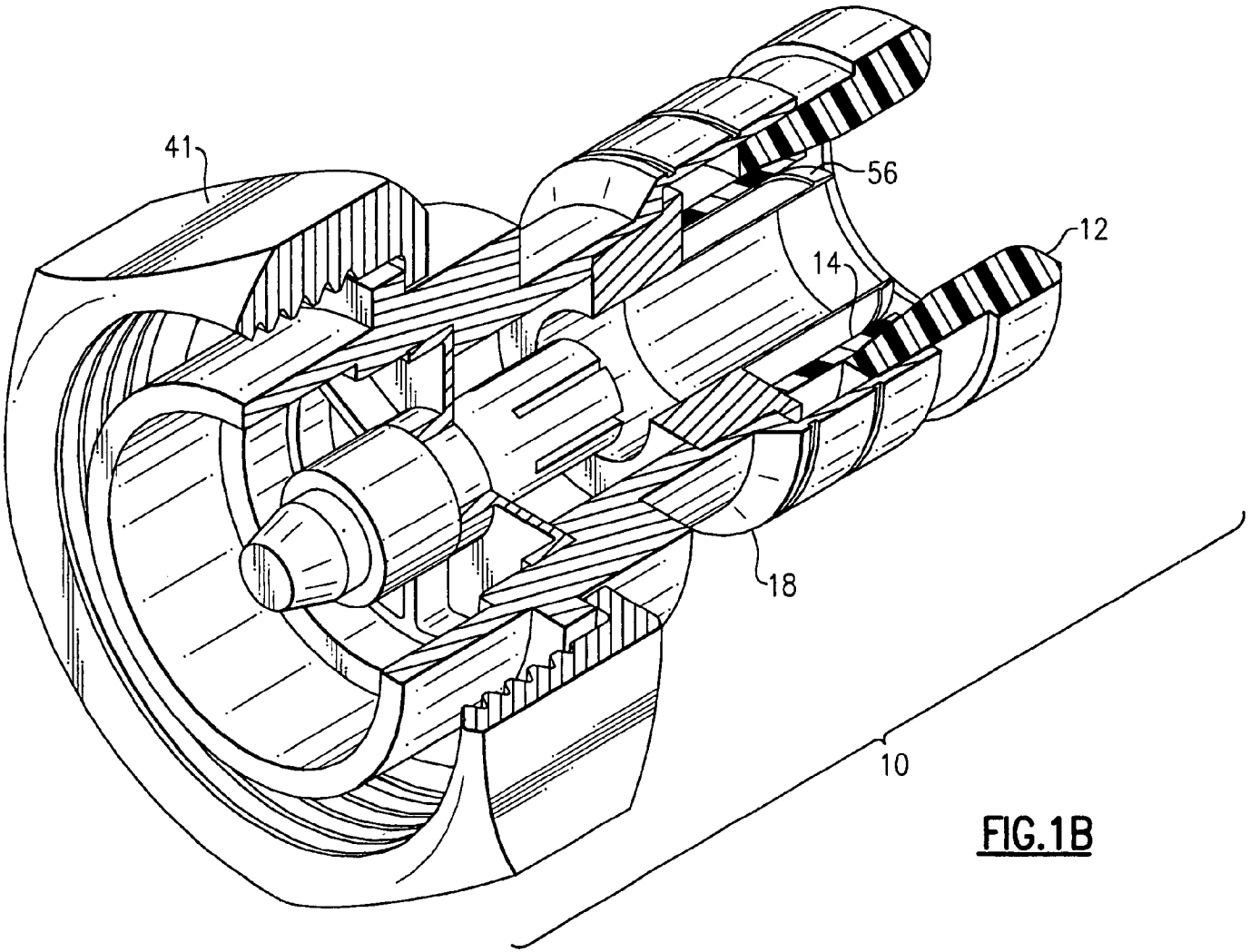
FIG. 1B is a cutaway perspective view of an alternative embodiment of the present invention shown in FIG. 1.

Referring to FIG. 1B, there is shown an alternative embodiment of the compression connector 10 of FIG. 1 in which the post 16 and the connector body 18 are integrated into a single member.

Referring to FIG. 1A, there is shown the compression connector 10 of FIG. 1 in which the compression wedge 12 has been moved to its installed position. The deformation of the compression ring 14 about the coaxial cable (which has been omitted for clarity) is evident.

As shown in FIGS. 1, 1A and 2, the compression connector 10 also includes a terminal end 60. In the embodiment shown, the terminal end 60 is a male DIN connector. The terminal end 60 includes a mandrel 62 which engages the central conductor of the coaxial cable and a spacer 64. The spacer 64 is an electrically non-conductive member (a dielectric material) that electrically isolates the mandrel 62 from the connector body 18. The spacer 64 shown is a substantially cylindrical member that engages a shoulder 66 at the distal end 42 of the central opening 19. It will be appreciated by those skilled in the art that although the illustrative embodiment of the spacer 64 is a substantially cylindrical member, other shapes may be used.

Preferably the compression connector 10 is provided as a self-contained, preassembled device ready for connection to a coaxial cable, however, in alternative embodiments the compression connector 10 may be provided as separate components that are individually assembled onto the coaxial cable prior to installation.

Figure 3:
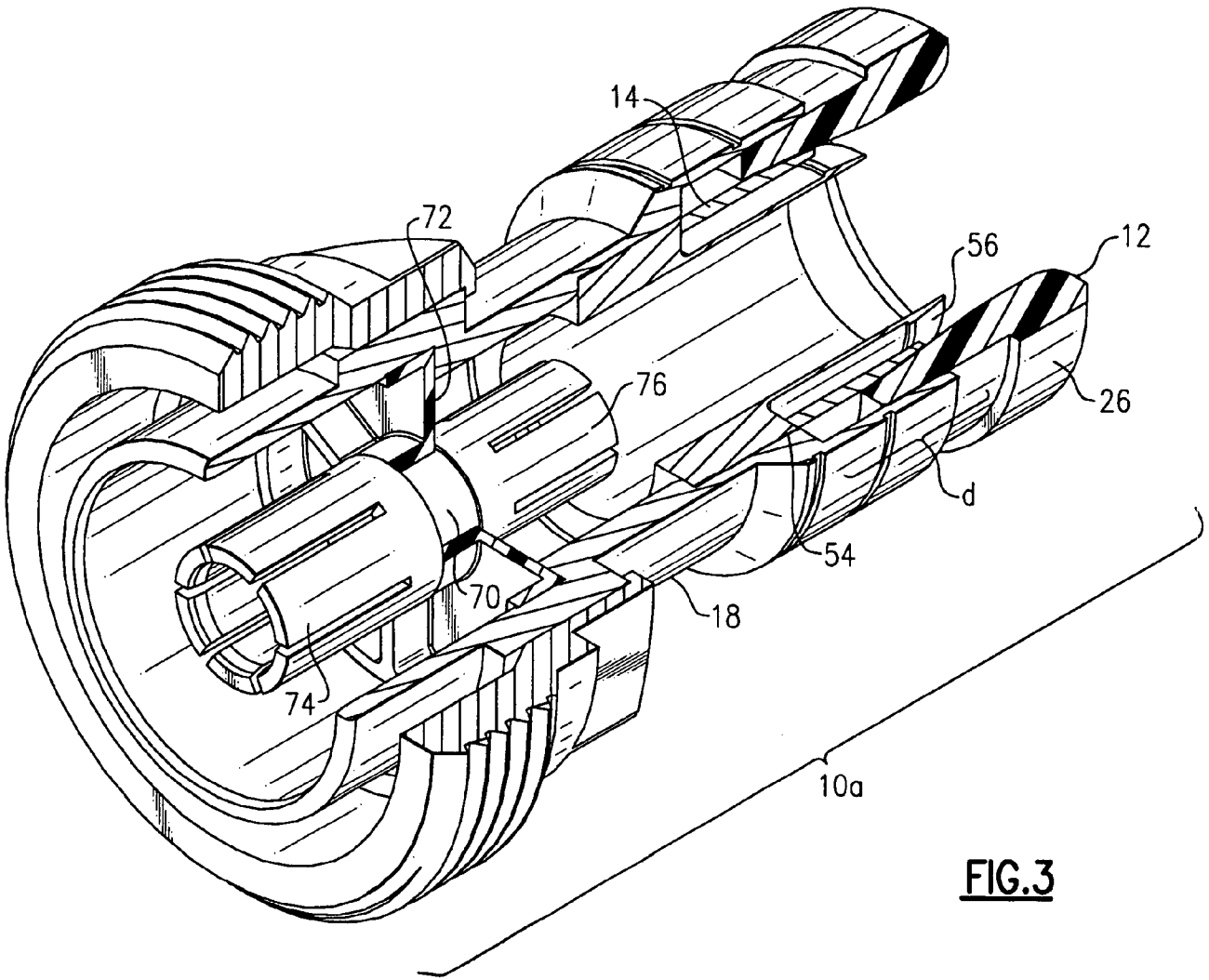
FIG. 3 is a cutaway perspective view of another embodiment of the present invention.

Turning to FIG. 3, there is shown a DIN female connector 10*a* embodiment of the present invention. The connector body 18 contains, as shown in FIG. 1, the compression wedge 12, the compression ring 14 and post 16. The body 18 also houses a collet 70 which is held in place by an insulator 72. A first end 74 of the collet 70 provides the female connection for a male DIN connector interface, while a second end 76 of the collet 70 provides the connection to the center conductor of the cable to which the connector 10*a* is being connected. The DIN female connector interface utilizes an externally threaded nut 80 in lieu of the internally threaded nut. The embodiment of the post 16 shown uses a single barb 56 located such that the distance d between the barb 56 and the shoulder 58 is at least as long as the length of the compression ring 14.

Figure 4:
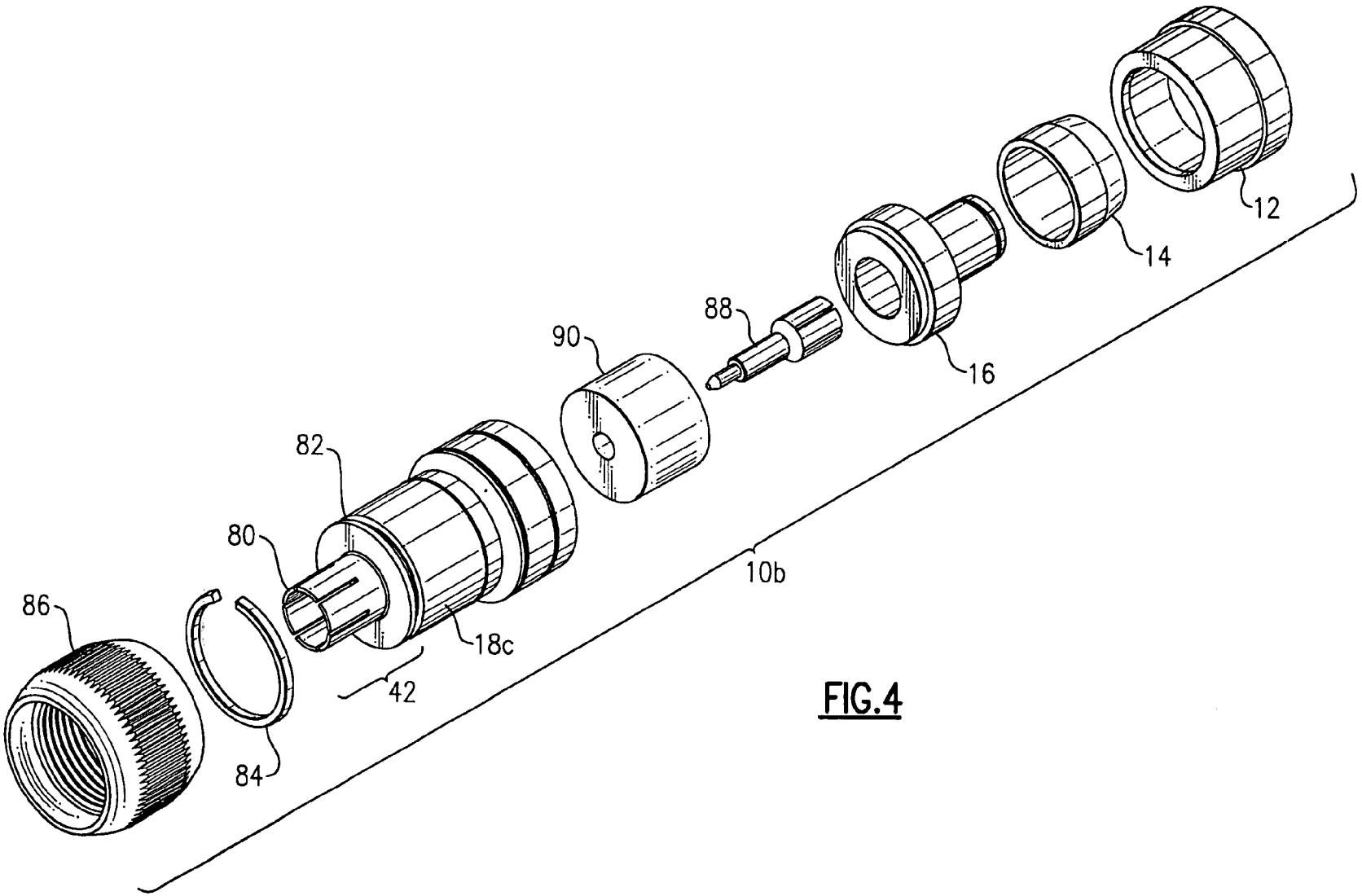
FIG. 4 is a exploded perspective view of another embodiment of the present invention.
Figure 5:
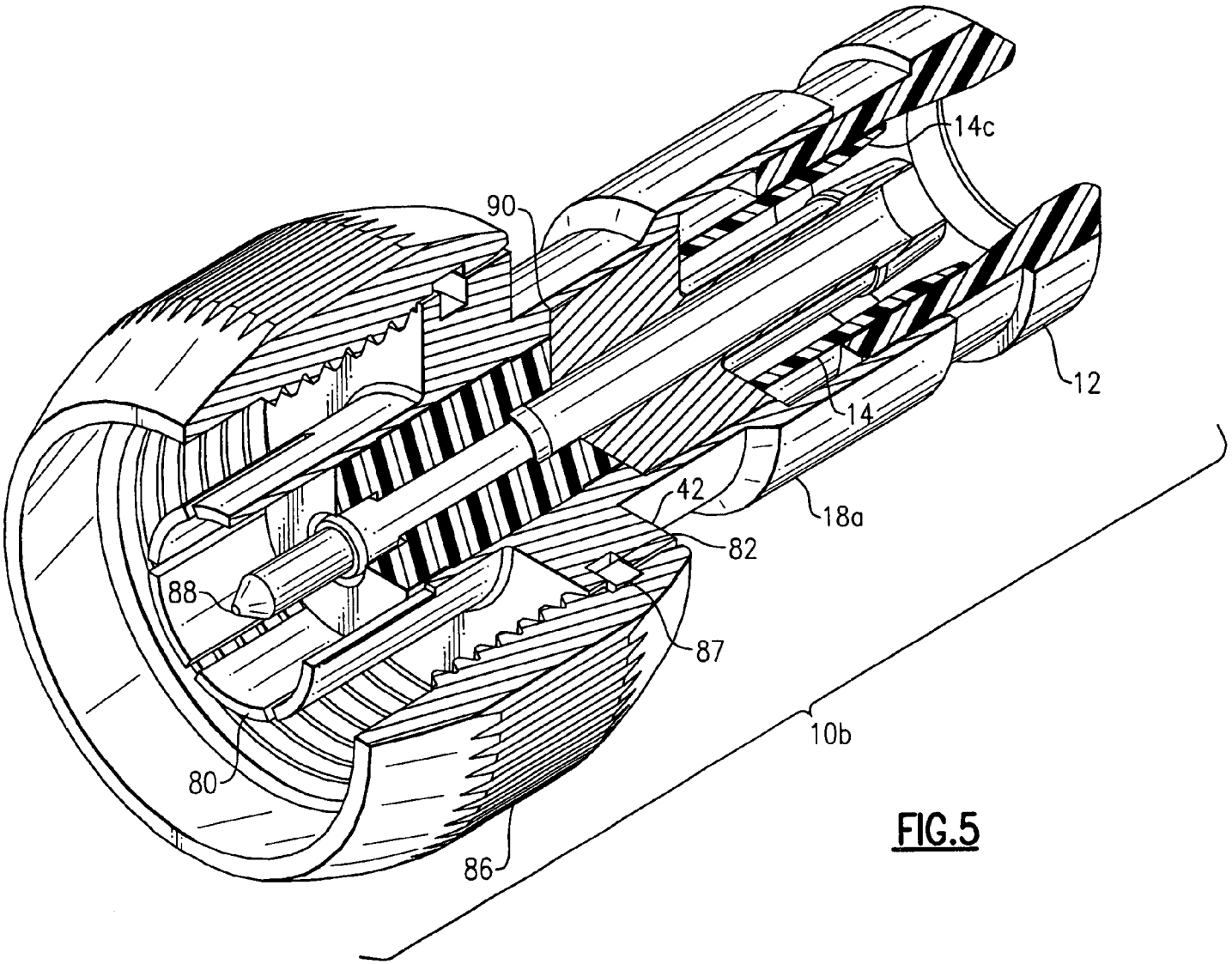
FIG. 5 is a cutaway perspective view of the embodiment of the present invention shown in FIG. 4.
Figure 5A:
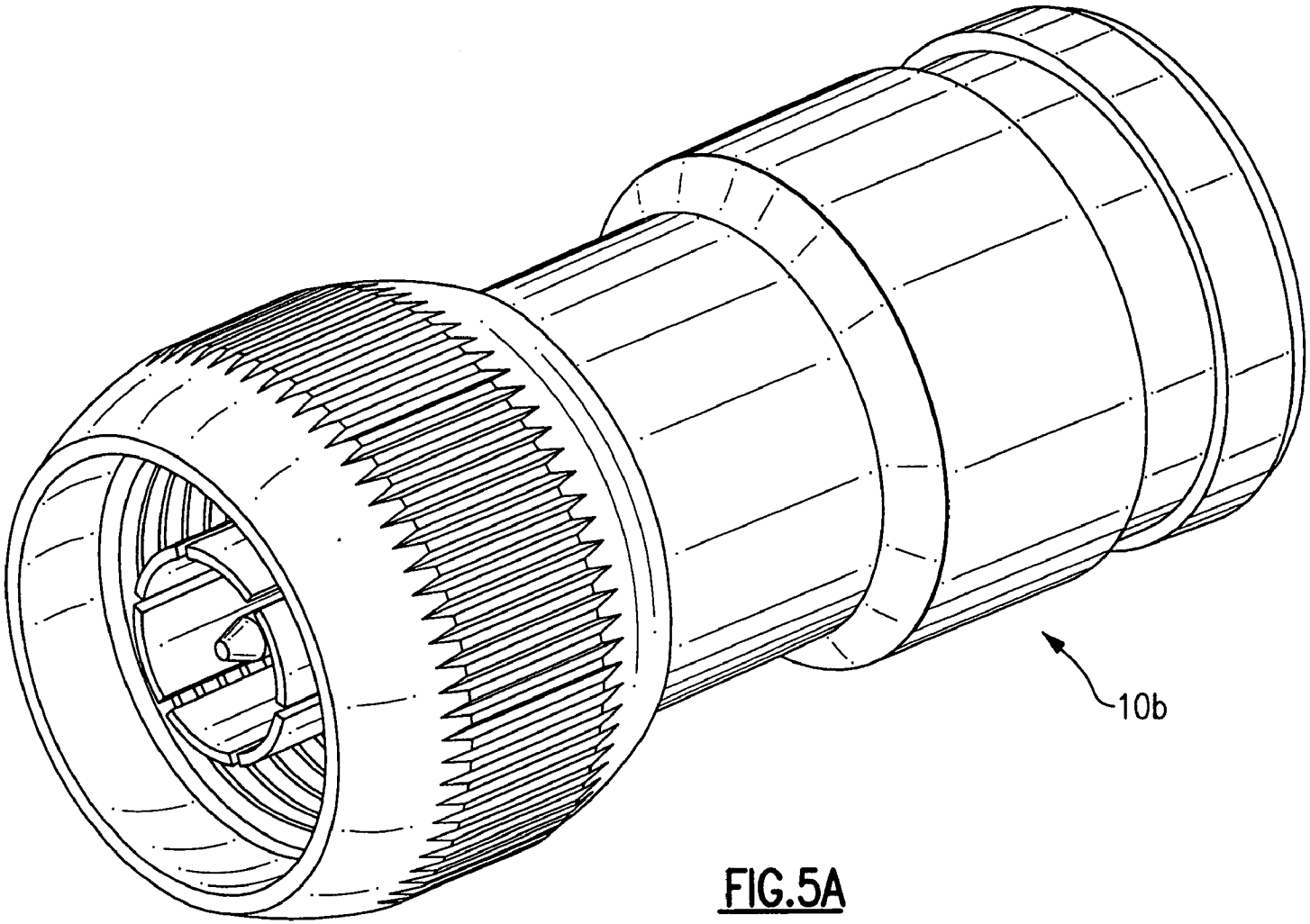
FIG. 5A is a perspective view of the embodiment of the invention shown in FIG. 4.

Referring to FIGS. 4 and 5, there is shown an N male connector embodiment of the present invention. The compression connector 10*b* includes a connector body 18*a*, a compression wedge 12, a compression ring 14 and a post 16. The compression wedge 12, compression ring 14 and post 16 are as described above. The connector body 18*a* is substantially as previously described with the exception of the distal end 42. The distal end 42 of the connector body 18 includes a collet 80 and an exterior annular groove 82. The collet 80 provides the female connection for a male N connector. The exterior annular groove 82 is adapted to receive a nut retaining ring 84. The nut retaining ring fits into an interior grove 87 in the internally threaded coupling nut 86 whereby the internally coupling nut 86 is coupled to the connector body 18*a*. The compression connector 10*b* further includes a mandrel 88 and an insulator 90. The mandrel 88 engages the center conductor of the coaxial cable that the compression connector 10*b* is being connected to. The mandrel 88 is held in place by the insulator 90 which electrically insulates the mandrel from the connector body 18*a*.

Figure 6:
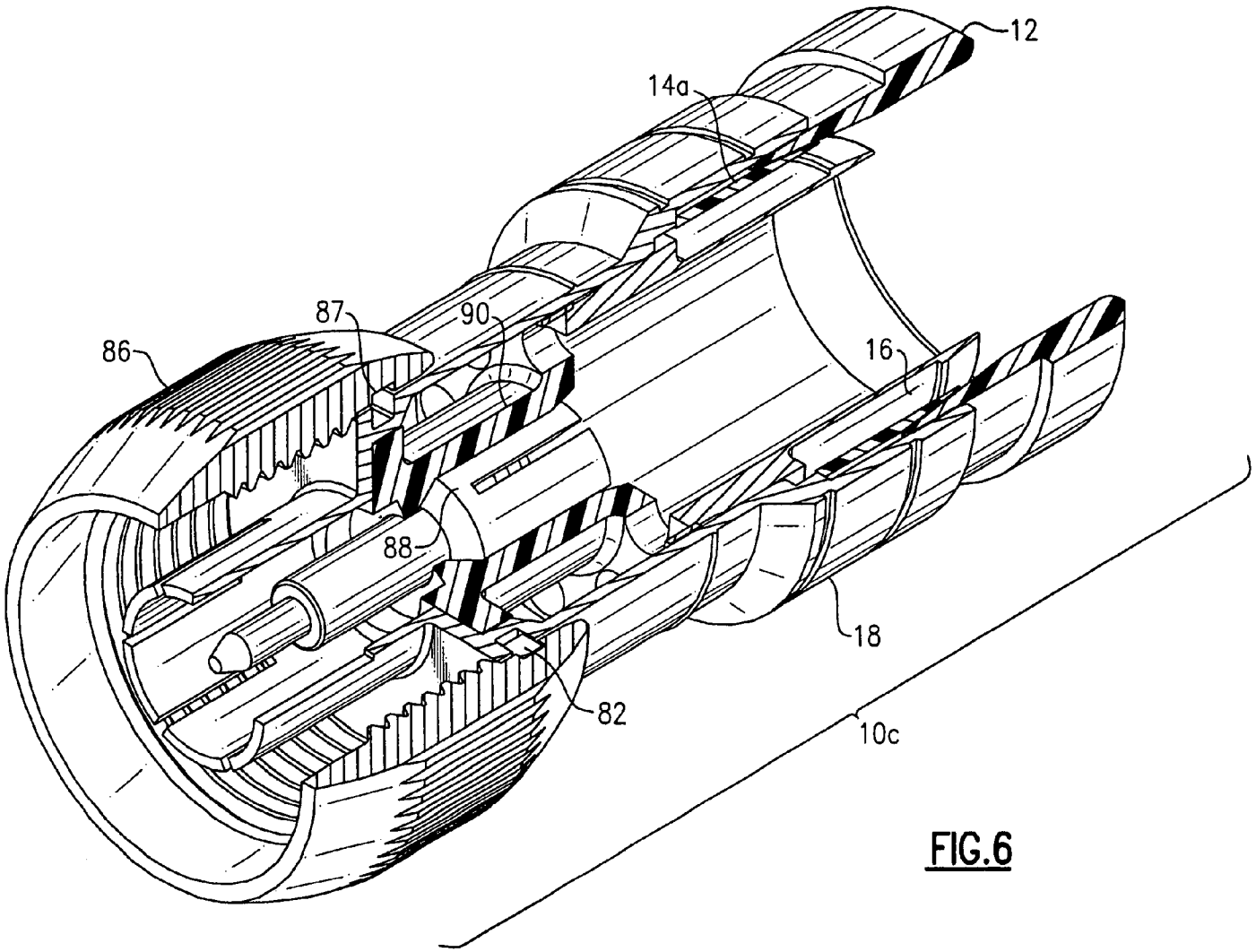
FIG. 6 is a cutaway perspective view of another embodiment of the present invention.

Referring to FIG. 6, there is shown an alternative embodiment of the N male connector shown in FIG. 4 and FIG. 5. The compression connector 10*c* is substantially identical to the compression connector 10*b*, differing in the configuration of the compression wedge 12*a*. The compression wedge 12*a* differs from the previously discussed compression wedges 12 in that the proximal end 12*b* of the compression wedge 12*a* engages a tapered surface 14*a* on the outer surface of compression ring 14. This is in contrast to the compression ring 14 of FIG. 5 showing a tapered surface on the inner surface. In FIG. 6, the tapered surfaces 12*b* and 14*a* interact to cause a radially inward deformation of the compression ring 14 as the compression wedge 12 moves from a first position towards a second position during installation of the compression connector 10 onto the end of a coaxial cable.

Figure 7:
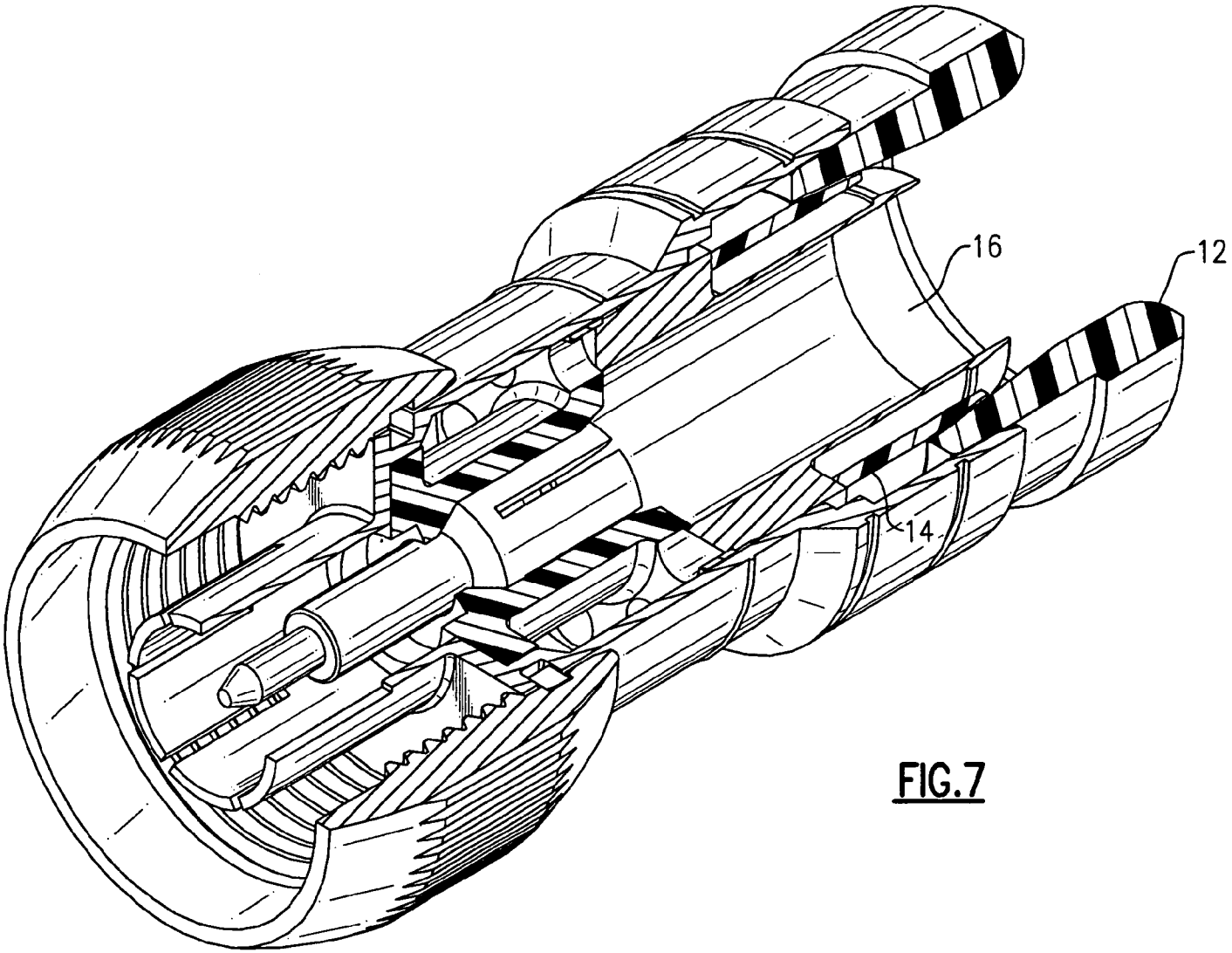
FIG. 7 is a cut away perspective view of another embodiment of the present invention.
Figure 8:
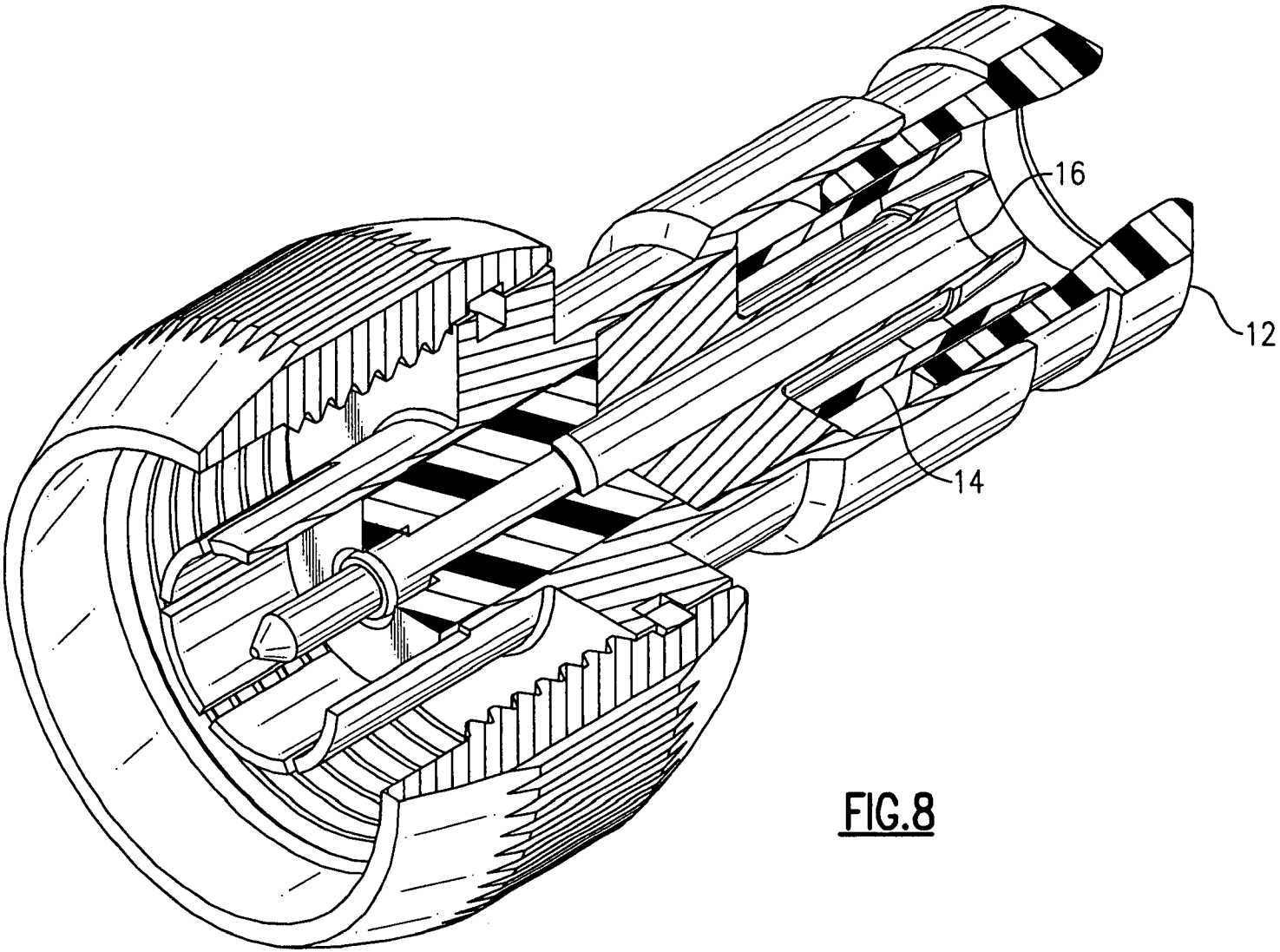
FIG. 8 is a cut away perspective view of another embodiment of the present invention.

Referring to FIG. 7 and FIG. 8, there is shown an alternative embodiment of the N male connector shown in FIG. 4 and FIG. 5. The compression connectors 10 shown in FIG. 7 and FIG. 8 illustrate how the dimensions of the compression wedge 12, the compression ring 14 and the post 16 may be varied to accommodate different diameter coaxial cables.

Figure 9:
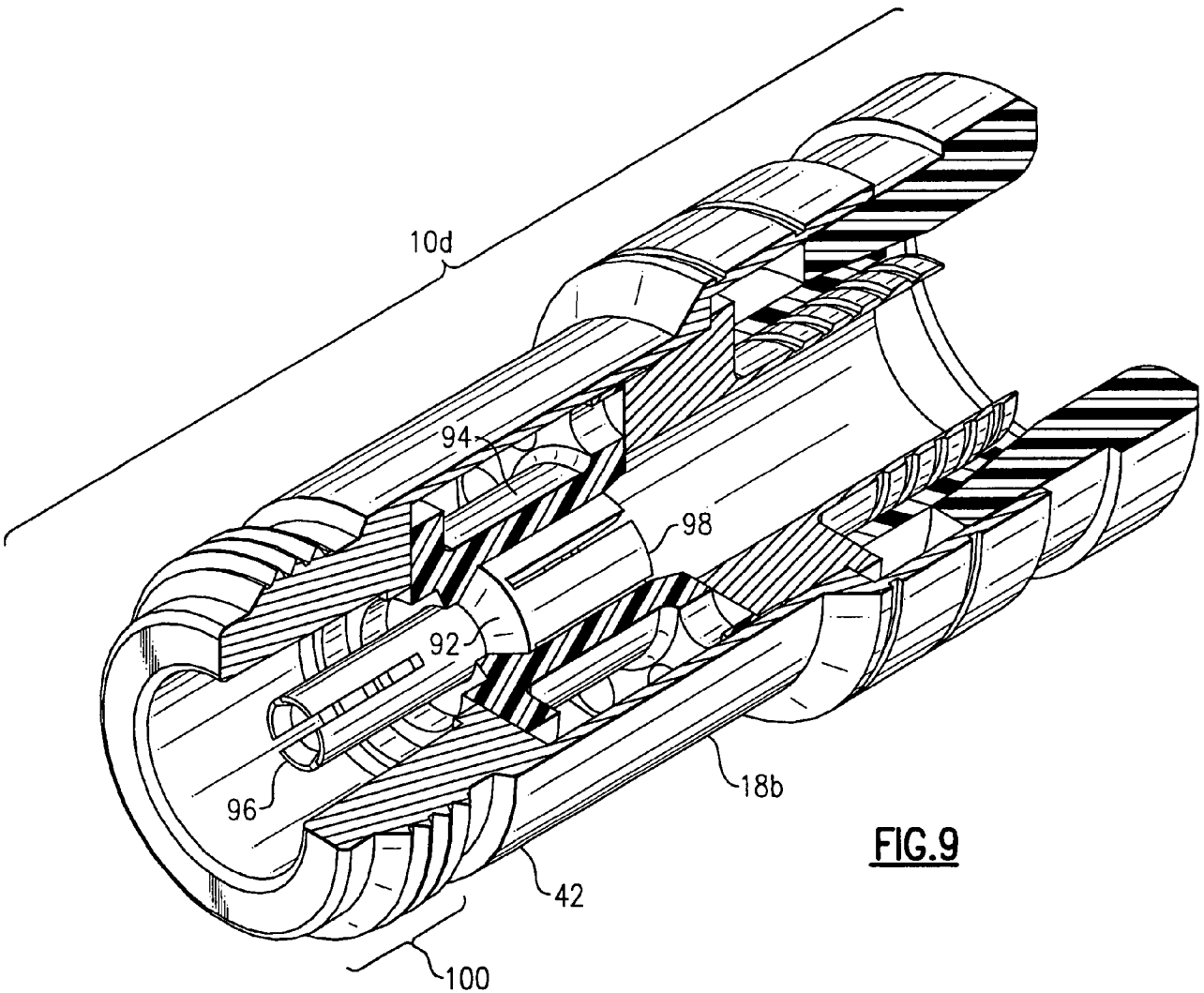
FIG. 9 is a cut away perspective view of another embodiment of the present invention.
Figure 10:
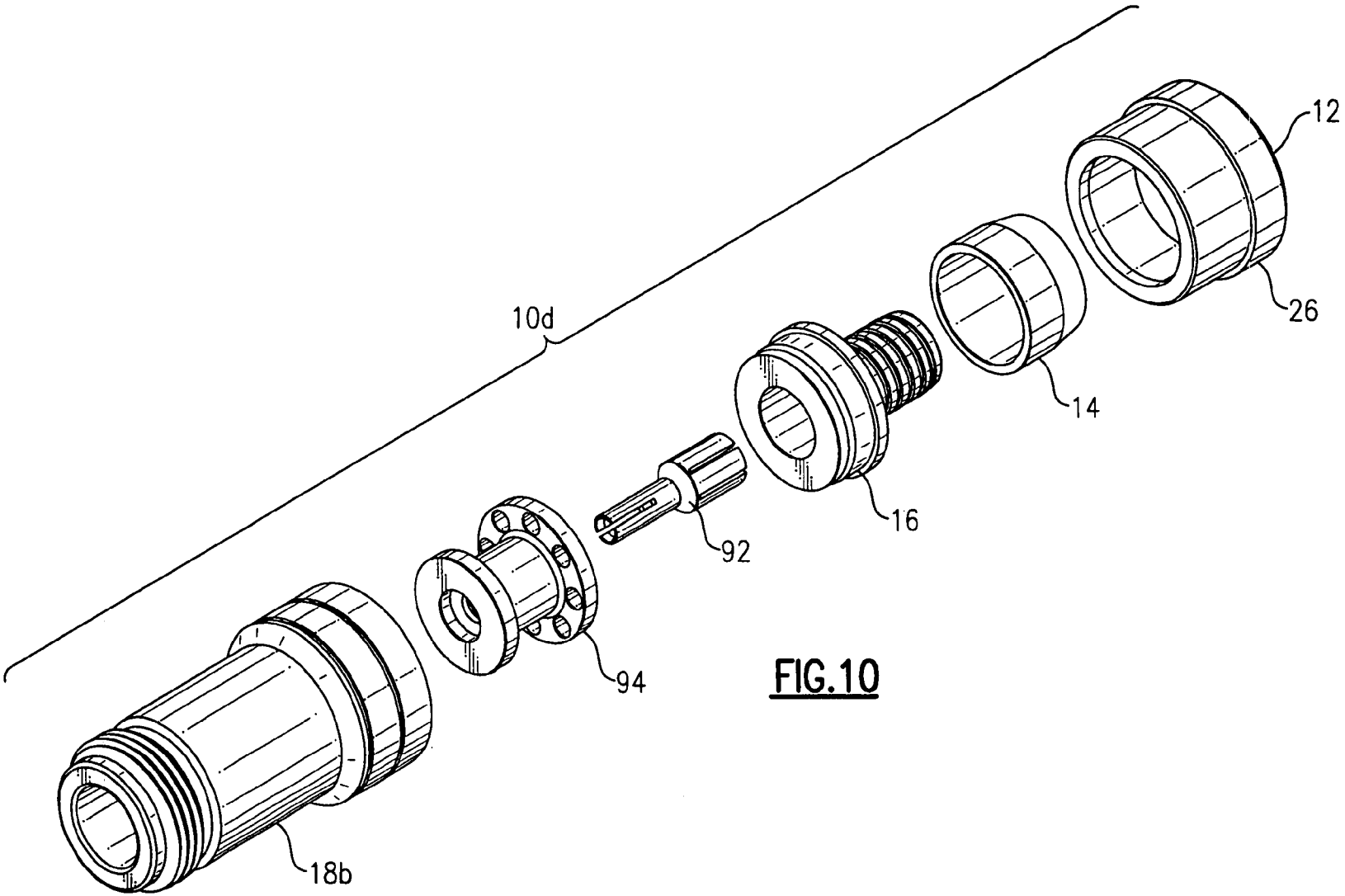
FIG. 10 is an exploded perspective view of the embodiment of the present invention shown in FIG. 9.

Referring to FIG. 9, there is shown a female N connector embodiment of the present invention. The compression connector 10*d* uses a different connector body 18*b* from compression connector 10*c* shown in FIG. 5 and FIG. 6. The distal end 42 includes an external threaded region 100 configured for connection, for example, to the coupling nut 86 of a male N connector. The distal end 42 of the connector body 18 houses a collet 92 which is held in place by an insulating spacer 94. A first end 96 of the collet provides the female connection for a male N connector, while a second end of the collet provides the connection for the center conductor of the cable being connected. A plastic mandrel (not shown) guides the center conductor of the cable into the second end 98 of collet 92. FIG. 10 is an exploded view of the compression connector 10*d* shown in FIG. 9.

Figure 11:
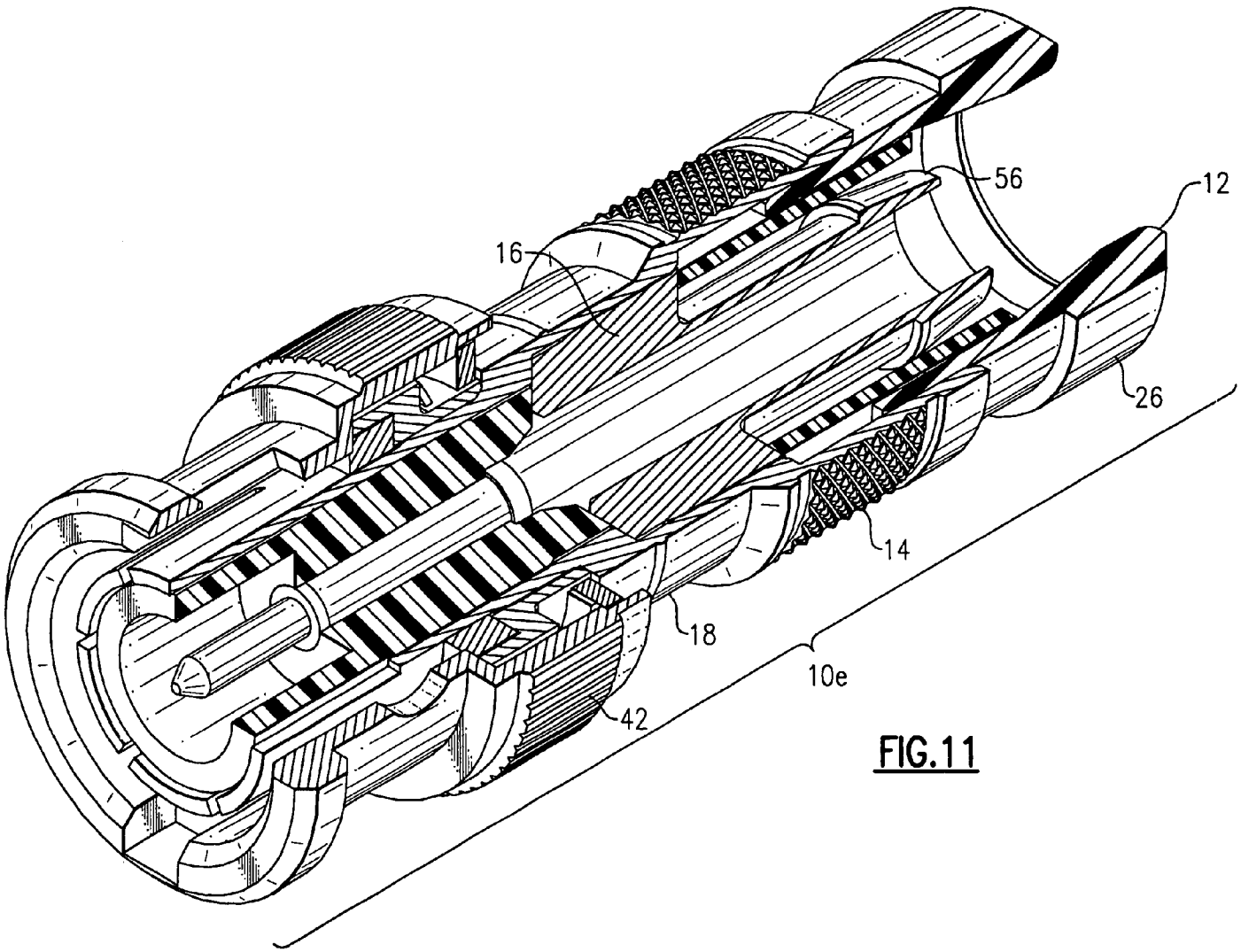
FIG. 11 is a cutaway perspective view of an alternative embodiment of the present invention.
Figure 12:
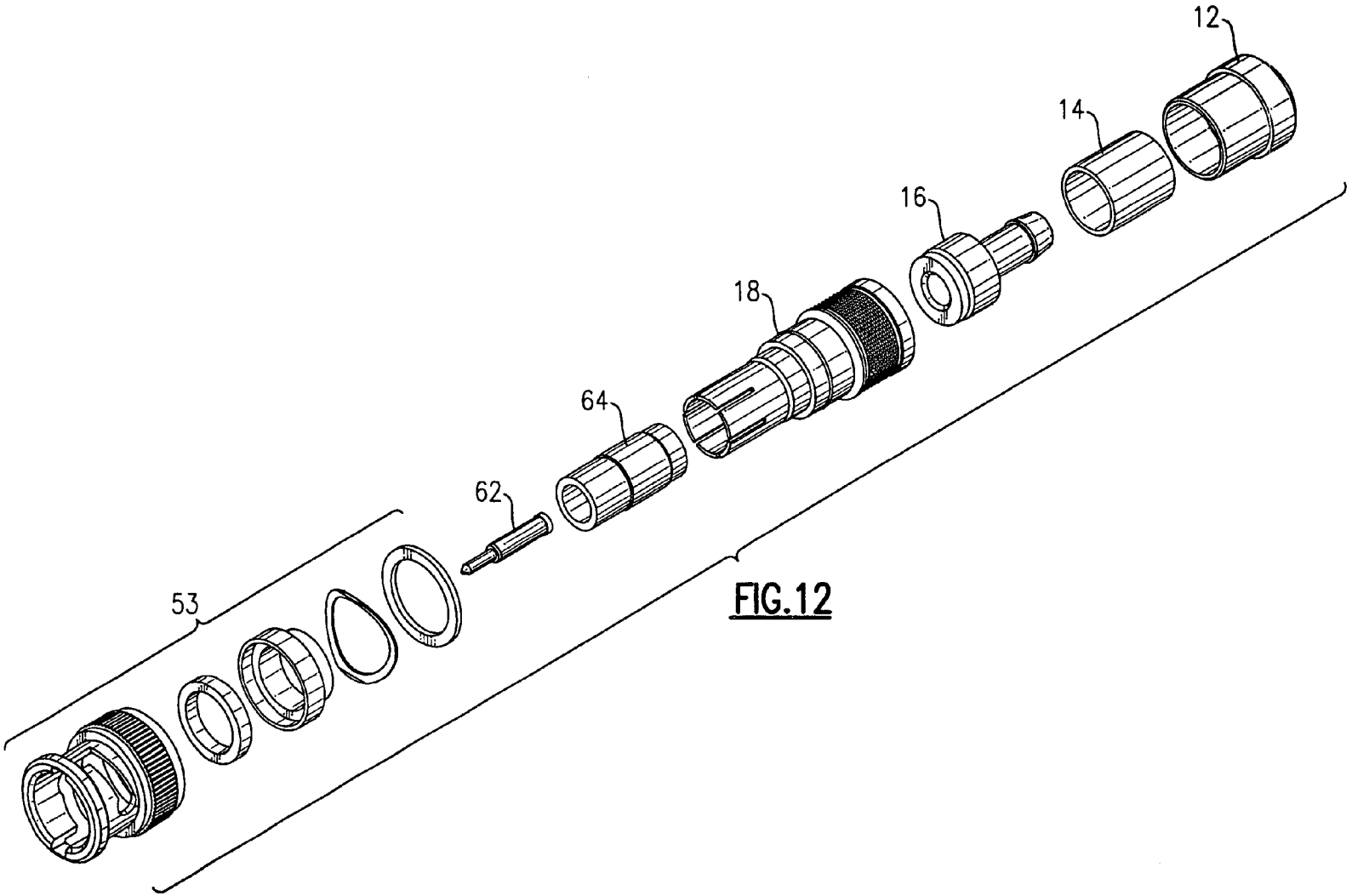
FIG. 12 is an exploded perspective view of an alternative embodiment of the present invention.

Referring to FIG. 11 and FIG. 12, there is shown a BNC connector embodiment of the present invention. The compression connector 10*e* is substantially similar to the previously described compression connectors differing only in that the distal end 42 of the connector body 18 is configured to receive a BNC style connector interface.

Figure 11A:
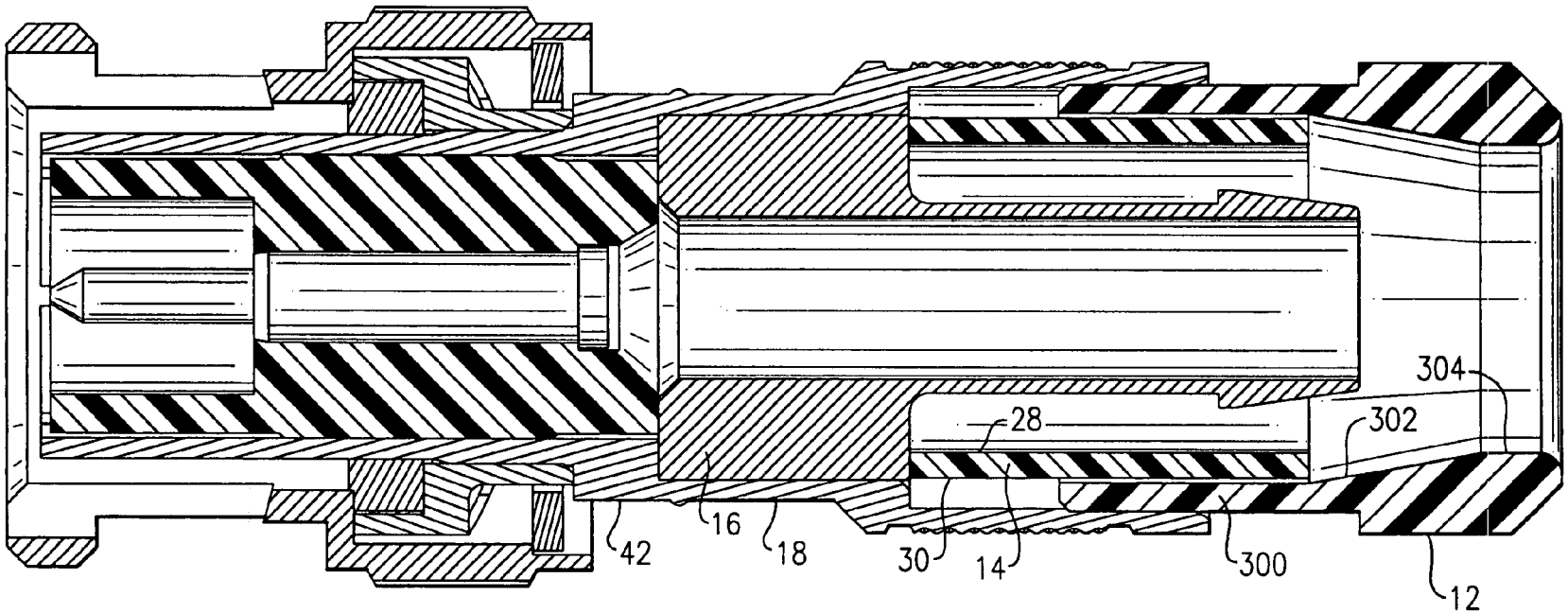
FIG. 11A is a cross sectional view of an alternative embodiment of the compression connector shown in FIG. 11.

Referring to FIG. 11A, there is shown a BNC connector 10*h* embodiment of the compression connector 10 of the present invention. In this embodiment, compression ring 14 is a tubular member having substantially parallel inner and outer surfaces 28, 30. The inner surface compression wedge 12 is divided into three sequential regions: a first substantially cylindrical region 300, an intermediate tapered region 302 and second substantially cylindrical region 304. The first substantially cylindrical region 300 is sized for either a clearance or slight interference fit with the outer surface 30 of the compression ring. The intermediate tapered region 302 is sized to engage the outer surface 30 of the compression ring 14 and to collapse the compression ring onto the protective jacket of the coaxial cable during installation.

Figure 13:
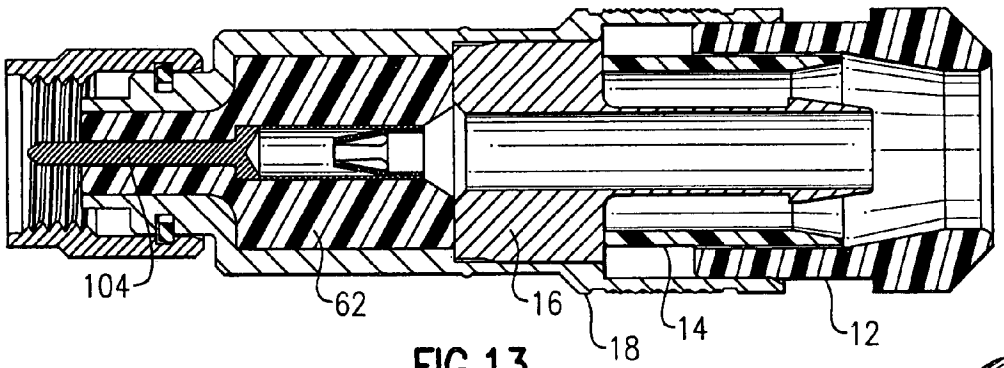
FIG. 13 is a cross sectional view of an alternative embodiment of the present invention.
Figure 14:
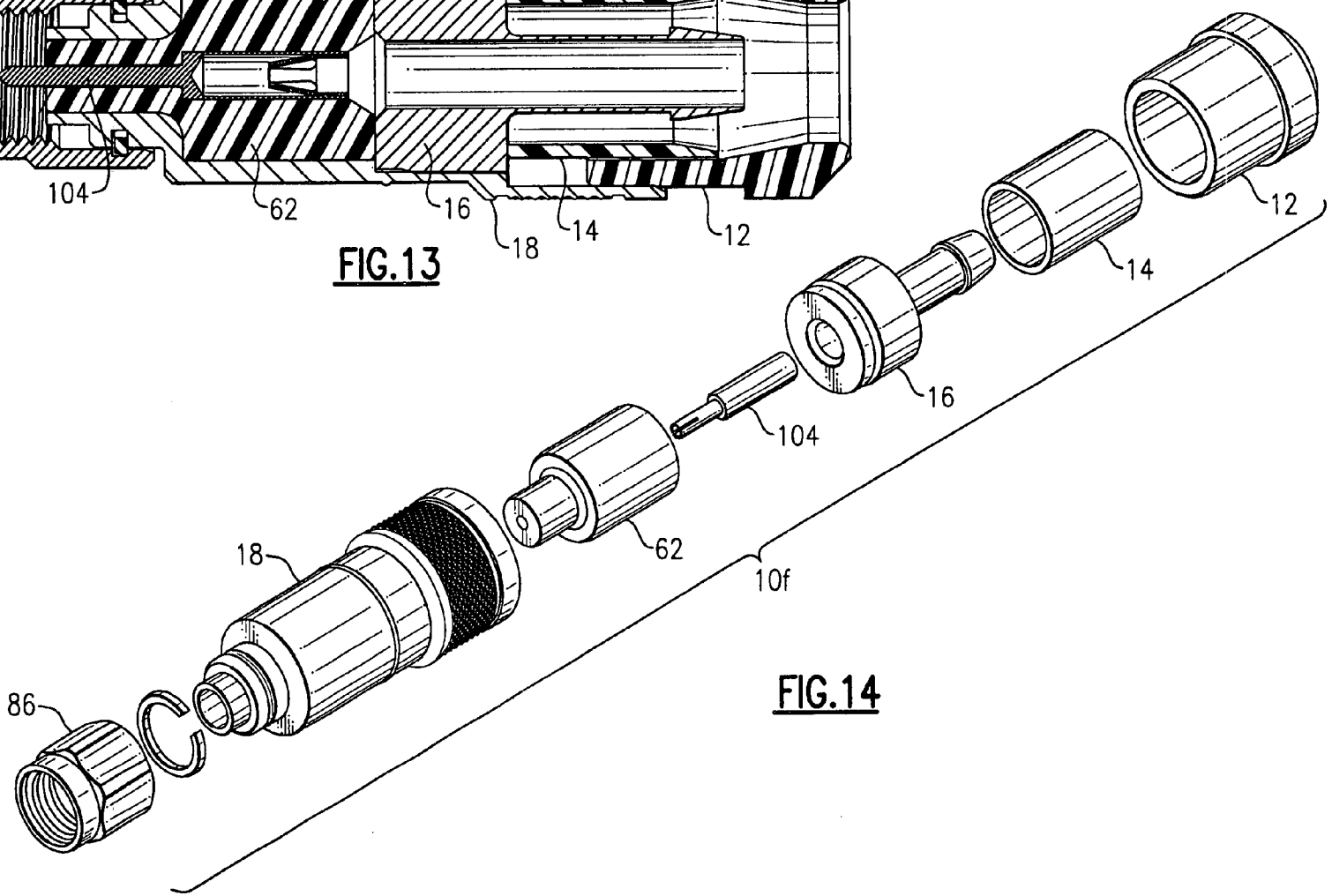
FIG. 14 is an exploded perspective view of the alternative embodiment of the present invention shown in FIG. 13.

Referring to FIG. 13 and FIG. 14, there is shown a male SMA connector embodiment of the present invention. The compression connector 10*f* is substantially similar to the previously described compression connectors differing only in that the distal end 42 of the connector body 18 includes an annular groove for a locking ring used to retain a coupling nut 86.

Figures 15, 16:
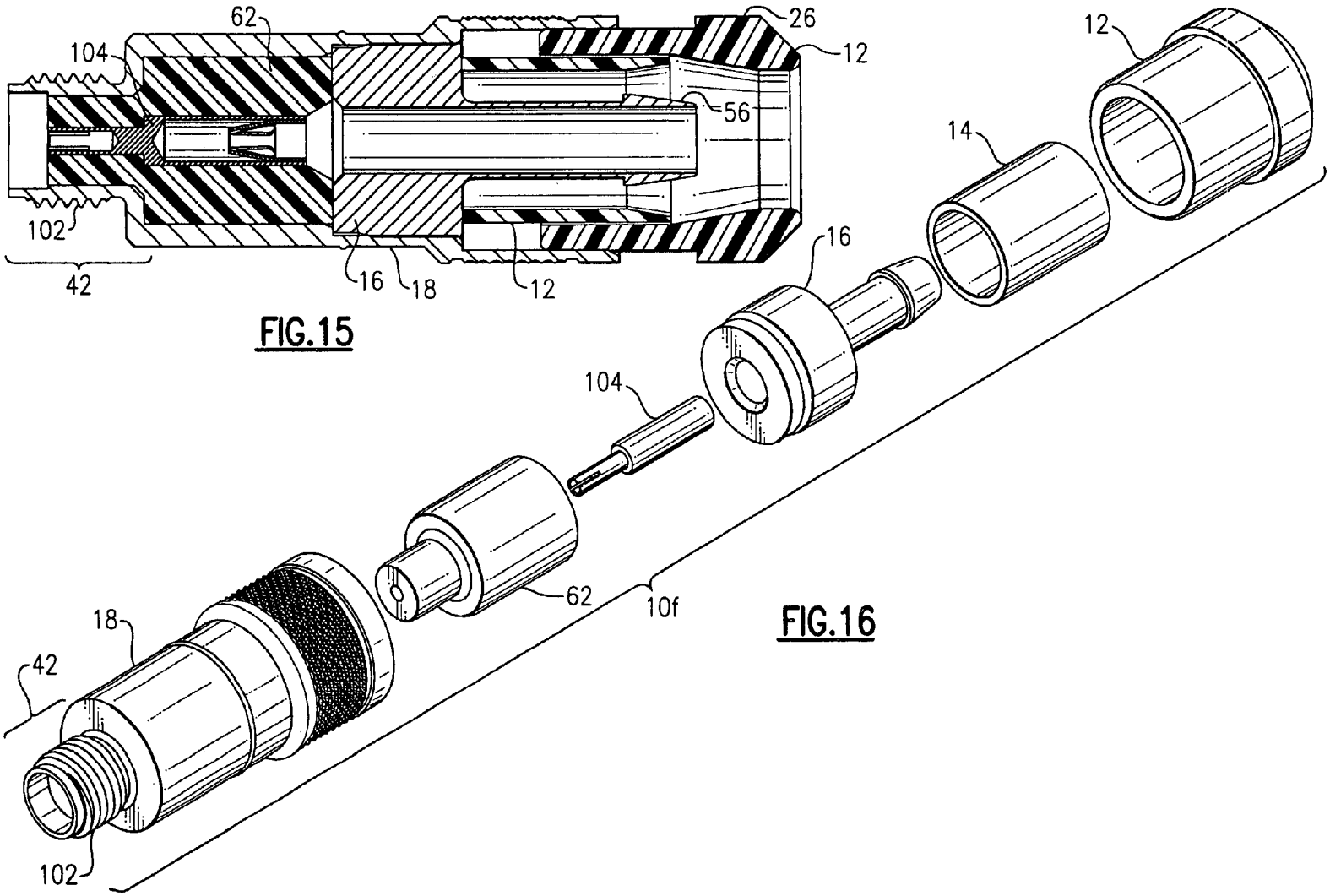
FIG. 15 is a cross sectional view of an alternative embodiment of the present invention.
FIG. 16 is a an exploded perspective view of the alternative embodiment of the present invention shown in FIG. 15.

Referring to FIG. 15 and FIG. 16, there is shown a female SMA connector embodiment of the present invention. The compression connector 10*f* is identical to the male SMA compression connector 10*f* of FIGS. 13 and 14 except that the mandrel has been replaced with a collet 104 and the distal end 42 includes an exterior threaded region 102.

All of preceding embodiments of the present invention may be readily adapted for different types of coaxial cable. For example different diameter cables, such as, for example 200, 400 and 500 size cables may be accommodated by varying the radial dimensions of the compression wedge 12, the compression ring 14 and the post 16.

Figure 17:
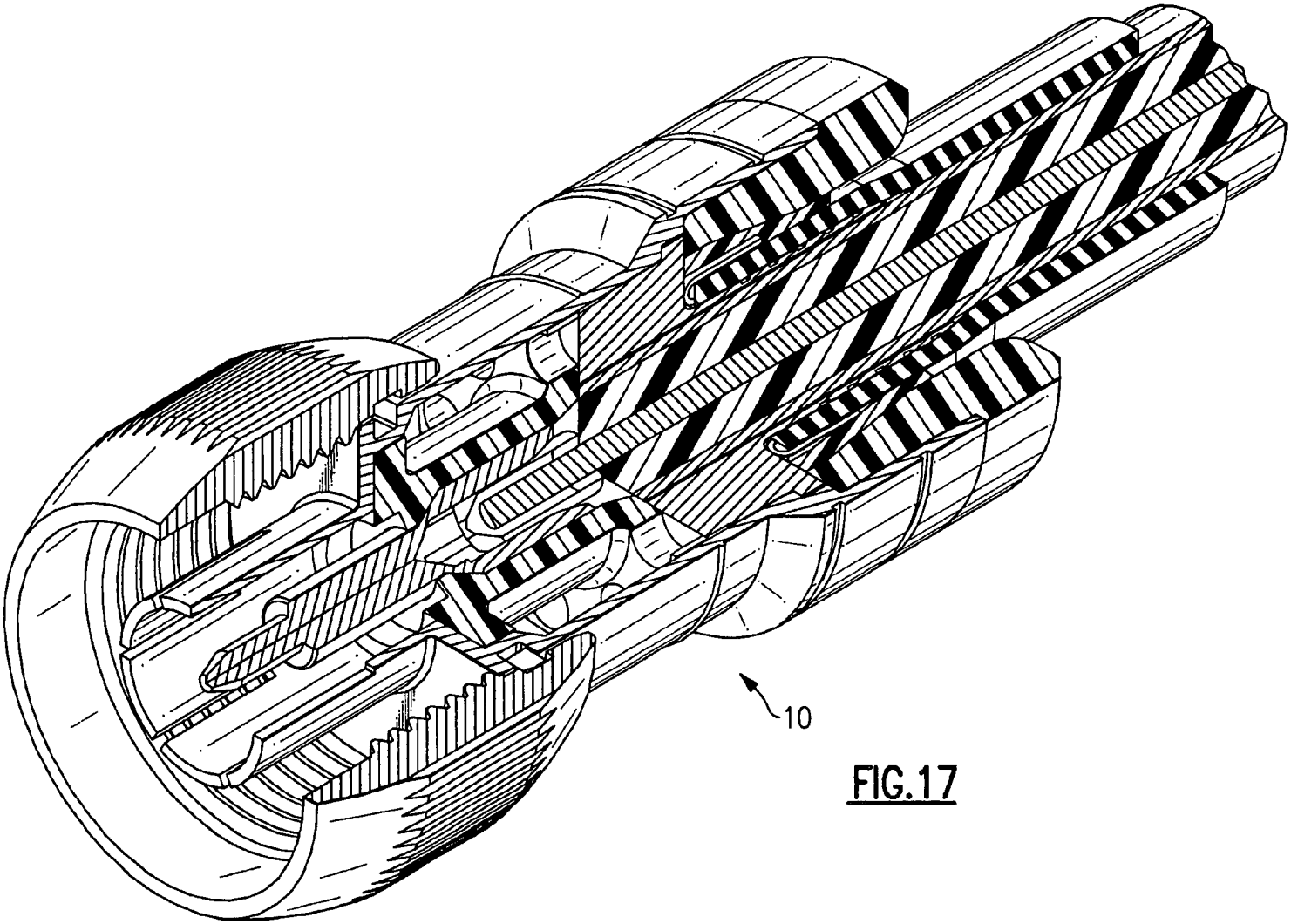
FIG. 17 is a cross sectional view of an embodiment of the present invention with a coaxial cable engaged.
Figure 17A:
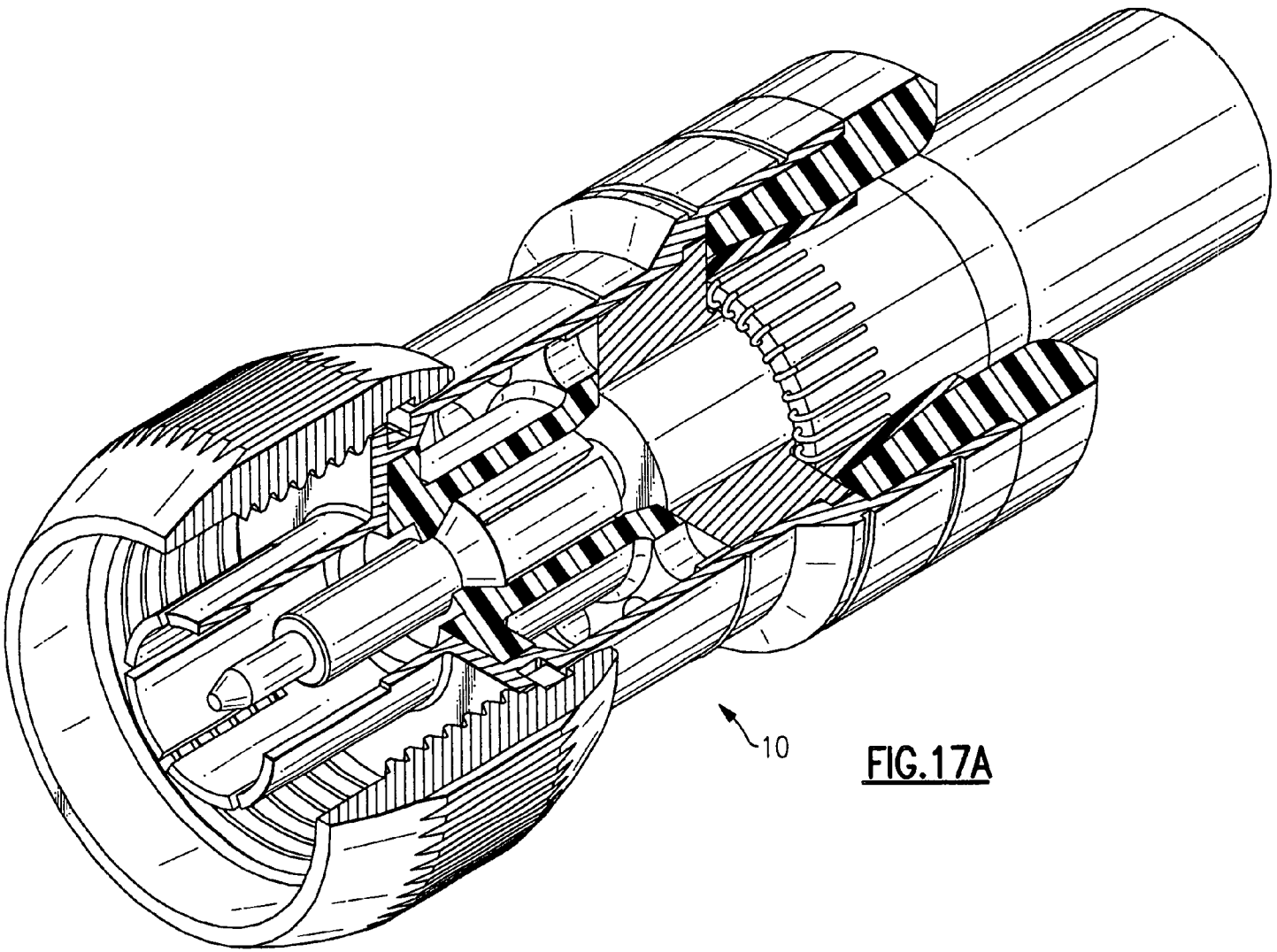
FIG. 17*a* is a cutaway perspective cross-sectional view of the embodiment of the present invention shown in FIG. 17 depicting the prepared end of the cable.

Referring to FIGS. 17 and 17*a* there is shown a compression connector 10 of the present invention installed on the end of a coaxial cable.

Figure 18:
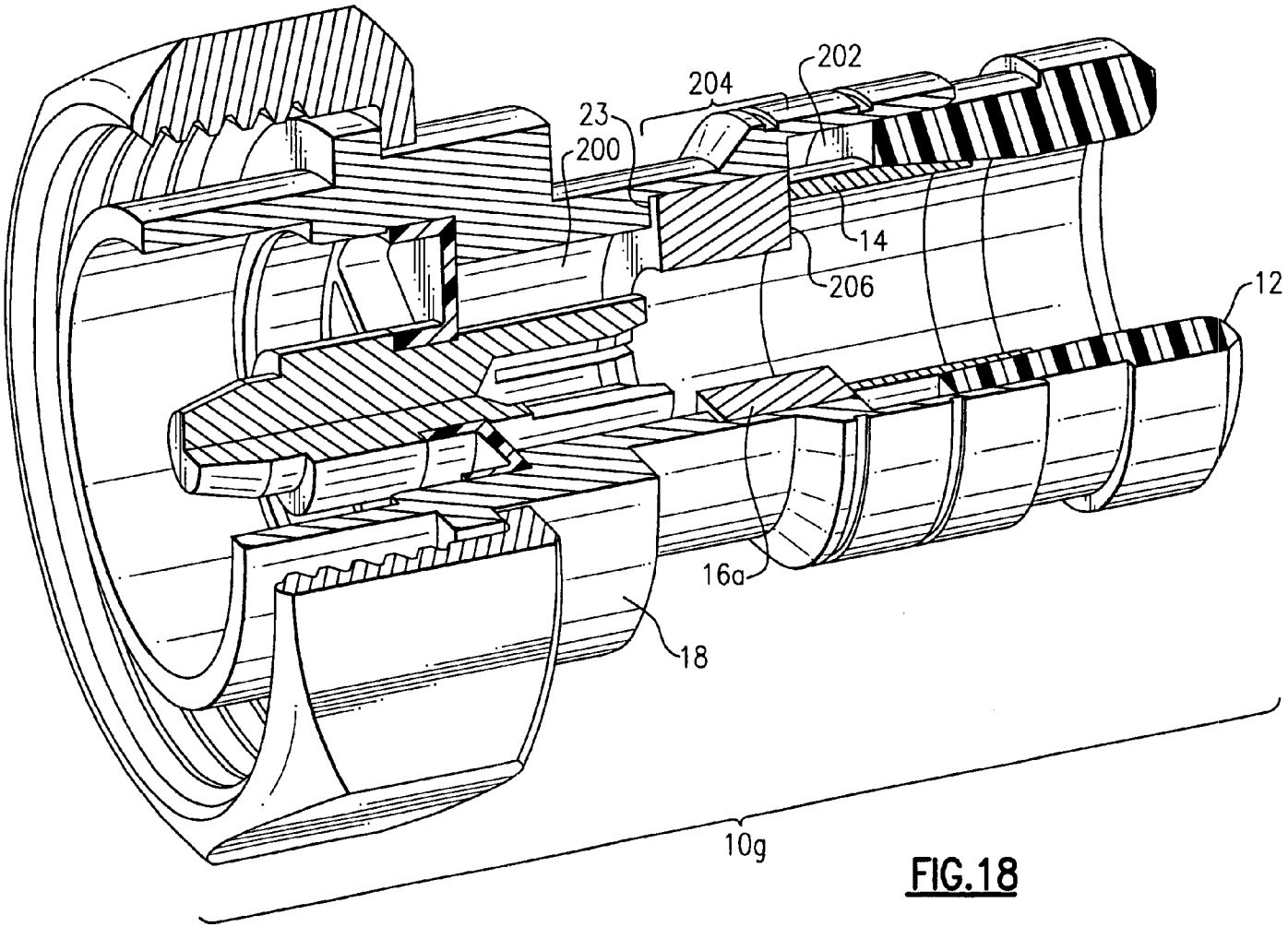
FIG. 18 is a cutaway perspective view of an alternative embodiment of the present invention.

Referring to FIG. 18 there is shown an alternative embodiment of the compression connector 10*g*. The compression connector 10*g* includes a connector body 18, a post 16*a*, a compression ring 14 and a compression wedge 12.

The connector body 18 includes a stepped internal passageway 200. An intermediate region 204 of the stepped internal passageway 200 is configured to receive the post 16*a*. The post 16*a* is seated against a shoulder 23 and is configured to have an interference fit sufficient to establish electrical connectivity between the post 16*a* and the connector body 18. In this embodiment, the post 16*a* is an electrically conductive tubular member having an outer diameter greater than the diameter of the cable to be coupled to the compression connector 10*g*. The inner diameter of the post 16*a* is sized to provide a slight interference fit with the first layer of foil over the dielectric layer of the prepared coaxial cable end. The slight interference fit between the first foil layer and the inner diameter of the post 16*a* establishes electrical connectivity between the post 16*a* and the first foil layer thereby allowing the rounding of the coaxial cable. The wall thickness of the post 16*a* allows one end 206 of the post to be used both as a stop for banking the folded over braid of the prepared coaxial cable end and as a stop for the compression ring 14.

The one end 202 of the stepped internal passageway 200 is configured to receive the compression ring 14 and the compression wedge 12. The compression ring 12 may be a deformable metallic member and may be a substantially cylindrical member having a substantially uniform wall thickness or may employ either internally or externally tapered walls or a combination of both. The compression ring 14 is configured to deform when the compression wedge 12 is placed in a predetermined position within the stepped internal passageway 200. When the compression ring 14 is comprised of a deformable metallic material, the deformation of the compression ring 12 engages the portion of the braid folded over the protective jacket of the coaxial cable establishing electrical connectivity therebetween. Furthermore, the compression ring 14 is pressed against the end 206 of the post 16*a* sufficiently to establish electrical connectivity there between.

The compression wedge 12 includes a central opening 20 oriented along the longitudinal axis of the compression wedge 12. The central opening 20 is substantially circular in cross section and is sized for a clearance fit with the outer protective jacket of a coaxial cable (not shown). The central opening 20 includes a tapered inner surface 22 having a substantially conical profile. The tapered inner surface 22 engages the outer surface 30 of the compression ring 14 to produce a radially inward force against the compression ring 14 as the compression wedge 12 moves from a first position towards a second position during installation of the compression connector 10 onto the end of a coaxial cable. The compression wedge 12 also includes a circumferential ring 26 configured for engagement with a compression tool. The circumferential ring 26 may also be positioned so as to prevent the compression wedge 12 from proceeding too far into the connector body 18 during installation. Typically, the compression wedge 12 is made from a metallic material, for example, brass, or a resilient plastic, such as Delrin®. The circumferential ring 26 may also be used to provide a visual indication that the compression connector 10 has been properly connected to the coaxial cable. As will be appreciated by those skilled in the art, although the compression connector of FIG. 18 is shown as a DIN connector, the compression connector 10*g* is easily modified, as evidenced by the other embodiments described herein, to incorporate any coaxial cable terminal type.

Figure 19:
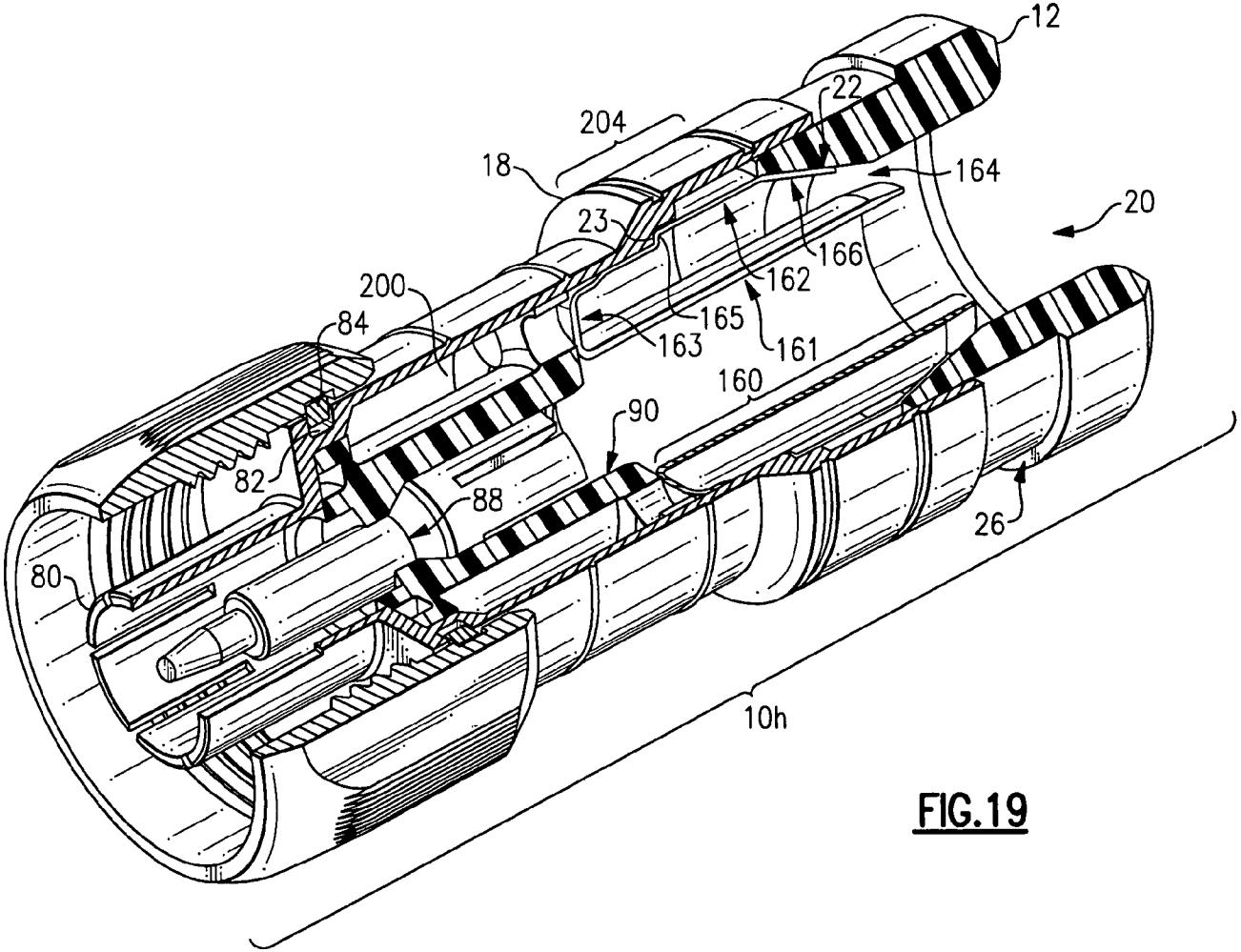
FIG. 19 is a cutaway perspective view of a further alternative embodiment of the present invention.

Referring to FIG. 19 there is shown an alternative embodiment of the compression connector 10*h* which is shown with an N male connector interface. The compression connector 10*h* includes a connector body 18, a compression wedge 12 and a deformable post 160. The connector body and the compression wedge are substantially the same as those described above with respect to FIGS. 4 and 5.

The connector body 18 includes a stepped internal passageway 200. An intermediate region 204 of the stepped internal passageway 200 is configured to receive the deformable post 160. The first proximal end of the connector body includes any of the well known interfaces discussed above, but is shown in this embodiment with an N male connector. The second distal end of the connector receives a deformable post 160 and compression wedge 12.

The deformable post 160 includes an inner sleeve 161, an outer sleeve 162, a first closed end 163 and a second open end 164. The inner sleeve of the deformable post is sized and configured to be inserted between the dielectric layer and grounding shield of a prepared end of a particularly sized coaxial cable (not shown). The outer sleeve includes a shoulder 165 to mate with the internal bore of the connector body and an inwardly tapered trailing edge 166 at the open end 164 to engage the ramped inner surface 22 of the compression wedge 12. The outer sleeve 162 is seated against a shoulder 23 on the connector body and is configured to have an interference fit sufficient to establish electrical connectivity between the deformable post 160 and the connector body 18. The first end of the deformable post 163 may be fully closed or partially closed but containing structure, such as radial support members between the inner and outer sleeves, to maintain the relative positions thereof. The inner 161 and outer sleeves 162 of the deformable post 160 define an annular space which is open at the second distal end for receiving the conductive grounding sheath and the protective outer jacket layers of the coaxial cable. The outer sleeve 162 of the deformable post 160 is configured to deform when the compression wedge 12 is advanced to a second axial compressed position within the stepped internal passageway 200.

The compression wedge 12 is generally as described above. The compression wedge 12 includes a central opening 20 oriented along the longitudinal axis of the compression wedge 12. The central opening 20 is substantially circular in cross section and is sized for a clearance fit with the outer protective jacket of a coaxial cable (not shown). The central opening 20 includes a tapered inner surface 22 having a substantially conical profile. The tapered inner surface 22 engages the outer surface of the outer sleeve 162 to produce a radially inward force against the outer sleeve of the post as the compression wedge 12 moves from a first position towards a second position during installation of the compression connector 10*h* onto the end of a coaxial cable. The compression wedge 12 also includes a circumferential ring 26 configured for engagement with a compression tool. The circumferential ring 26 may also be positioned so as to prevent the compression wedge 12 from proceeding too far into the connector body 18 during installation. The circumferential ring 26 may also be used to provide a visual indication that the compression connector 10 has been properly connected to the coaxial cable.

The distal end 42 of the connector body 18 includes a collet 80 and an exterior annular groove 82. The collet 80 provides the female connection for a male N connector interface. The exterior annular groove 82 is adapted to receive a nut retaining ring 84. The nut retaining ring 84 fits into an interior grove 87 in the internally threaded coupling nut 86 whereby the internally coupling nut 86 is coupled to the connector body 18*a*. The compression connector 10*h* further includes a mandrel 88 and an insulator 90. The mandrel 88 engages the center conductor of the coaxial cable that the compression connector 10*h* is being connected to. The mandrel 88 is held in place by the insulator 90 which electrically insulates the mandrel 88 from the connector body 18.

The compression wedge 12 is pressed into the open distal end of the connector body in a first preassembled configuration. As the compression wedge 12 is axially advanced, the ramped inner surface 22 of the compression wedge 12 reduces the volume of the annular space between the inner 161 and outer sleeves 162 of the deformable post. The outer sleeve is thus deformed into engagement with the outer surface of the cable.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A compression connector for the end of a coaxial cable, the coaxial cable having a center conductor surrounded by a dielectric layer, the dielectric layer being surrounded by a conductive grounding sheath, and the conductive grounding sheath being surrounded by a protective outer jacket, the compression connector comprising:

a body including a first end and a second end, the body defining an internal passageway;

a post sized and configured for engagement with the body at a portion of the internal passageway, said post having a inner sleeve, an outer sleeve, a first open end and a second end, the inner sleeve at the first open end configured for engagement with a portion of the conductive grounding sheath;

a compression member having a first end and a second end, the first end including an outer surface and an inner surface, the outer surface configured for sliding engagement with a portion of the internal passageway at the first end of the body, the inner surface configured for engagement with the outer sleeve of the post whereby upon sliding advancement of the compression member, the outer sleeve of the post is deformed against the outer jacket of the coaxial cable.

2. The compression connector of claim 1 wherein the inner surface of the compression member includes a ramped surface.

3. The compression connector of claim 1 further wherein the post establishes an electrical connection between the connector body and the conductive grounding shield of the coaxial cable.

4. The compression connector of claim 1 wherein the internal passageway of the body further includes a first shoulder for the engagement of the post.

5. The compression connector of claim 4 wherein the outer sleeve of the post includes a second shoulder for engagement of the first shoulder of the internal passageway of the body.

6. The compression connector of claim 2 wherein the first open end of the outer sleeve of the post engages the ramped inner surface of the compression member.

7. The compression connector of claim 1 further including:

a mandrel disposed within the internal passageway at the second end of the body, the mandrel adapted to receive the center conductor of the coaxial cable and thereby establish electrical connectivity between the mandrel and the center conductor; and a spacer disposed between the mandrel and the body, the spacer engaging both the mandrel and the body and holding each apart from one another in a predetermined position, whereby the central conductor is electrically isolated from the conductive grounding sheath and the body.

8. The compression connector of claim 7 wherein the second end of the body includes a connector interface being chosen from the group of connector interfaces including a BNC connector, a TNC connector, an F-type connector, an RCA-type connector, a DIN male connector, a DIN female connector, an N male connector, an N female connector, an SMA male connector and an SMA female connector.

9. The compression connector of claim 1 wherein the inner sleeve and the outer sleeve are integral to the post.

10. A preassembled compression connector for the end of a coaxial cable, the coaxial cable having a center conductor surrounded by a dielectric layer, the dielectric layer being surrounded by a conductive grounding sheath, and the conducting grounding sheath being surrounded by a protective outer jacket, the compression connector comprising:

a body including a first end and a second end, the body defining an internal passageway;

a post having an inner sleeve and an outer sleeve, first open end and a second end, the inner sleeve at the first open end configured for engagement with a portion of the conductive grounding sheath, a portion of the outer sleeve of the post configured for engagement with the body between the first and the second end of the internal passageway;

a compression member having a first end and a second end, the compression member slidably moveable from a first position at the first end of the body to a second position at least partially disposed within the body, the first end including an outer surface and an inner ramped surface, the outer surface configured for engagement with a portion of the internal passageway at the first end of the body and the inner ramped surface configured to engage and deform the outer sleeve of the post radially inwardly against the outer jacket of the coaxial cable upon advancement of the compression member from the first position to the second position.

11. The compression connector of claim 10 further including:

a mandrel disposed within the internal passageway at the second end of the body, the mandrel adapted to receive the center conductor of the coaxial cable and thereby establish electrical connectivity between the mandrel and the center conductor; and a spacer disposed between the mandrel and the body, the spacer engaging both the mandrel and the body and holding each apart from one another in a predetermined position, whereby the central conductor is electrically isolated from the conductive grounding sheath and the body.

12. The compression connector of claim 10 wherein the first open end of the outer sleeve includes a tapered outer surface configured for engagement with the inner ramped surface of the compression member.

13. The compression connector of claim 11 wherein the second end of the connector body includes a connector interface being chosen from the group of connector ends including a BNC connector, a TNC connector, an F-type connector, an RCA-type connector, a DIN male connector, a DIN female connector, an N male connector, an N female connector, an SMA male connector and an SMA female connector.

14. The compression connector of claim 10 wherein the inner sleeve and the outer sleeve are integral to the post.

15. A compression connector for the end of a coaxial cable, the coaxial cable having a center conductor surrounded by a dielectric layer, the dielectric layer being surrounded by a conductive grounding sheath, and the conductive grounding sheath being surrounded by a protective outer jacket, the terminal comprising:

means for electrically connecting the coaxial cable to an electrical device including a post having an inner sleeve, an outer sleeve and a connector body, said inner sleeve configured for insertion between the grounding sheath and dielectric layer of the cable, said outer sleeve configured for an interference fit with said connector body;

means for receiving the coaxial cable; and means for applying a circumferential clamping force to the protective outer jacket of the coaxial cable whereby the coaxial cable is coupled to the compression connector.

16. The compression connector of claim 15 wherein the means for applying a circumferential clamping force includes a compression member with an inner ramped surface.

17. The compression connector of claim 14 wherein the means for electrically connecting the coaxial cable to an electrical device further includes a mandrel for engaging the center conductor.

18. The compression connector of claim 15 wherein the means for receiving the coaxial cable is a compression member disposed at one end of a connector body defining an internal passageway and a post disposed within said internal passageway having an inner sleeve and an outer sleeve whereby the center conductor and dielectric layer are received within the inner sleeve of the post and the grounding sheath and the protective outer jacket of the cable are received between said inner and outer sleeves of the post.

19. A method for installing a compression connector on the end of a coaxial cable, the coaxial cable having a center conductor surrounded by a dielectric layer, the dielectric layer being surrounded by a conductive grounding sheath, and the conductive grounding sheath being surrounded by a protective outer jacket, the method comprising the steps of:

providing a connector in a first preassembled configuration, the connector including:

a connector body with a first end and a second end, the body defining an internal passageway;

a post member disposed within the internal passageway, said post member having an inner sleeve and an outer sleeve, said inner sleeve configured for engagement with a portion of the grounding sheath and dielectric layer of the cable;

a compression member disposed proximate the first end of the body to receive the end of the coaxial cable, said compression member having an inner ramped surface configured to engage the outer sleeve of the post member;

preparing an end of the coaxial cable by separating a portion of the protective jacket and grounding sheath from the center conductor and dielectric;

inserting the prepared coaxial cable end into the connector such that the grounding sheath and outer jacket are disposed between the inner sleeve and the outer sleeve of the post;

using a tool that engages the compression member and the connector body, forcibly sliding the compression member from the first preassembled configuration, further into said connector body to an compressed second configuration such that the compression member concentrically compresses at least a portion of the outer sleeve of the post inwardly against the outer conductor of the coaxial cable.

20. A method for installing a compression connector on the end of a coaxial cable of claim 19 including the additional steps of:

providing a mandrel within the internal passageway at the second end of the body, the mandrel adapted to receive the center conductor of the coaxial cable and a spacer disposed between the mandrel and the body, the spacer electrically isolating the mandrel from the body;

preparing the cable by further removing a portion of the dielectric layer to expose a section of the center conductor for insertion into the mandrel;

inserting the exposed section of the center conductor into the mandrel.

* * * * *

UNITED STATES PATENT AND TRADEMARK OFFICE

CERTIFICATE OF CORRECTION

PATENT NO. : 7,048,579 B2
APPLICATION NO. : 11/092197
DATED : May 23, 2006
INVENTOR(S) : Noah Montena It is certified that error appears in the above-identified patent and that said Letters Patent is hereby corrected as shown below:

Detailed Description Of The Invention:

Column 8, Line 55, the reference numeral "18a" is incorrect. Please replace with --18c--.

Column 9, Line 49, the reference to a "BNC style connector interface" is incomplete. Please replace with --BNC style connector interface 53--.

Column 12, Line 20, the reference to the "internally coupling nut 86" is incomplete. Please replace with --internally threaded coupling nut 86--.

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,048,579 B2
APPLICATION NO. : 11/092197
DATED : May 23, 2006
INVENTOR(S) : Noah Montena It is certified that error appears in the above-identified patent and that said Letters Patent is hereby corrected as shown below:

Detailed Description Of The Invention:

Column 8, Line 55, the reference numeral "18a" is incorrect. Please replace with --18c--.

Column 9, Line 49, the reference to a "BNC style connector interface" is incomplete. Please replace with --BNC style connector interface 53--.

Column 12, Line 20, the reference to the "internally coupling nut 86" is incomplete. Please replace with --internally threaded coupling nut 86--.

Signed and Sealed this

Fifth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 7,048,579 B2
APPLICATION NO. : 11/092197
DATED : May 23, 2006
INVENTOR(S) : Noah Montena It is certified that error appears in the above-identified patent and that said Letters Patent is hereby corrected as shown below:

Detailed Description Of The Invention:

Column 8, Line 55, the reference numeral "18a" is incorrect. Please replace with --18c--.

Column 9, Line 49, the reference to a "BNC style connector interface" is incomplete. Please replace with --BNC style connector interface 53--.

Column 12, Line 20, the reference to the "internally coupling nut 86" is incomplete. Please replace with --internally threaded coupling nut 86--.

Signed and Sealed this

Twenty-first Day of November, 2006

JON W. DUDAS
*Director of the United States Patent and Trademark Office*